US007731997B2

(12) United States Patent
Castellanos et al.

(10) Patent No.: US 7,731,997 B2
(45) **Date of Patent: *Jun. 8, 2010**

(54) CONTAINER FOR FOOD PRODUCTS

(75) Inventors: Carolina Castellanos, DeForest, WI (US); Daniel Eugene Doucette, DeForest, WI (US)

(73) Assignee: Kraft Foods Global Brands, LLC, Northfield, IL (US)

( * ) Notice: Subject to any disclaimer, the term of this patent is extended or adjusted under 35 U.S.C. 154(b) by 8 days.

This patent is subject to a terminal disclaimer.

(21) Appl. No.: 12/030,839

(22) Filed: Feb. 13, 2008

(65) Prior Publication Data

US 2008/0128424 A1 Jun. 5, 2008

Related U.S. Application Data

(63) Continuation of application No. 11/626,791, filed on Jan. 24, 2007, now abandoned, which is a continuation of application No. 10/260,863, filed on Sep. 27, 2002, now Pat. No. 7,172,779.

(51) Int. Cl.
*B65B 25/06* (2006.01)

(52) U.S. Cl. ..... 426/106; 426/129; 206/714; 206/784

(58) Field of Classification Search ..... 426/106, 426/129; 206/714, 784
See application file for complete search history.

(56) References Cited

U.S. PATENT DOCUMENTS 3,154,215 A 10/1964 LeVesconte
3,338,723 A 8/1967 Lundquist
3,344,974 A 10/1967 Bostrom
3,371,848 A 3/1968 Ward et al.
3,467,244 A 9/1969 Mahaffy et al.
3,469,682 A * 9/1969 Cline ..... 206/525
3,498,018 A 3/1970 Seiferth et al.
3,584,430 A * 6/1971 Shearer ..... 53/453
D227,083 S 6/1973 Anderson et al.
3,833,742 A * 9/1974 Wetmore et al ..... 426/129
3,972,155 A 8/1976 Mahaffey et al.
4,268,530 A 5/1981 Wyslotsky (Continued)

OTHER PUBLICATIONS

"John Morrell Introduces Deli Delivered!™,"The National Provisioner, Sep. 2002, p. 42.

(Continued)

*Primary Examiner*—Anthony Weier
(74) *Attorney, Agent, or Firm*—Fitch Even Tabin & Flannery

(57) ABSTRACT

Various packages for food products are provided herein. In one embodiment, a food package has a rectangular substantially planar rigid bottom wall; two slanted side/side walls extending angularly upwardly from the bottom wall, each forming an angle of from about 55 to about 75 degrees from vertical axes extending orthogonally from a plane formed by the bottom wall; and a rectangular opening opposite the bottom wall, the opening larger in area than the rectangular rigid bottom wall. A top side wall and a bottom side wall extend upwardly from the bottom wall; and a flexible film extends over the opening and seals the opening. The side walls are configured to engage and hold the food product, each side wall being angularly ramped and extending downward and inward toward the bottom wall, and having at least one wall which extends downwardly from the angularly upward extending side wall.

23 Claims, 11 Drawing Sheets

U.S. PATENT DOCUMENTS

| | | | |
|---|---|---|---|
| D276,026 | S | 10/1984 | Hexamer |
| RE31,762 | E | 12/1984 | Vosti et al. |
| 4,538,651 | A | 9/1985 | Lykins |
| D296,191 | S | 6/1988 | Yoshida et al. |
| 4,866,911 | A | 9/1989 | Grindrod et al. |
| 4,935,252 | A | 6/1990 | Huang et al. |
| 4,946,038 | A | 8/1990 | Eaton |
| 5,123,527 | A | 6/1992 | Hustad |
| 5,129,517 | A | 7/1992 | Hustad |
| 5,167,973 | A | 12/1992 | Snyder |
| D334,141 | S | 3/1993 | Gottofredi |
| D334,536 | S | 4/1993 | Long et al. |
| D336,850 | S | 6/1993 | Guillin |
| D337,268 | S | 7/1993 | Detert et al. |
| 5,236,119 | A | 8/1993 | Chu |
| 5,293,997 | A | 3/1994 | Hustad et al. |
| D348,394 | S | 7/1994 | Dreyer |
| D349,456 | S | 8/1994 | Wilson |
| D357,259 | S | 4/1995 | Bold et al. |
| 5,421,510 | A | 6/1995 | Calvert |
| D368,030 | S | 3/1996 | Elbaz |
| 5,533,228 | A | 7/1996 | Jarecki et al. |
| 5,545,420 | A | 8/1996 | Lipinski et al. |
| 5,558,891 | A | 9/1996 | Lawless et al. |
| 5,582,853 | A | 12/1996 | Marnocha et al. |
| 5,592,775 | A | 1/1997 | Dew |
| 5,695,798 | A | 12/1997 | Rozzano |
| 5,747,084 | A | 5/1998 | Cochran et al. |
| 5,795,604 | A | 8/1998 | Wells et al. |
| 5,913,425 | A | 6/1999 | Thomas et al. |
| 5,919,501 | A | 7/1999 | Rozzano |
| 5,922,376 | A | 7/1999 | Privert |
| D418,371 | S | 1/2000 | Whitehead |
| 6,048,558 | A | 4/2000 | Feldmeier et al. |
| 6,050,027 | A | 4/2000 | Pavelka et al. |
| 6,092,664 | A | 7/2000 | Bartosek |
| D430,023 | S | 8/2000 | Shurtleff et al. |
| RE36,867 | E | 9/2000 | Rozzano |
| D432,409 | S | 10/2000 | Feldmeier |
| D450,240 | S | 11/2001 | Haag et al. |
| 6,360,885 | B1 | 3/2002 | Krueger et al. |
| 6,467,647 | B1 | 10/2002 | Tucker et al. |
| D474,687 | S | 5/2003 | Jones et al. |
| D482,277 | S | 11/2003 | Castellanos et al. |
| D522,355 | S | 6/2006 | Castellanos et al. |
| 7,172,779 | B2 * | 2/2007 | Castellanos et al. ..... 426/106 |
| 2007/0116805 | A1 | 5/2007 | Castellanos et al. |

OTHER PUBLICATIONS

Shaved Meat Package Photograph, International Sial Food Show, Oct. 2002, Paris, France, (as described in e-mail from ilcox, Cindee L., to inventor Carolina Castellanos, May 2, 2003), two pages.

"Hillshire Farm's Ultra-Thin Deli Select® lunchmeats," The National Provisioner, Jul. 2002, p. 65.

"Lunchmeats Launch in Reusable PP Containers," Packworld.com, http://www/packworld.com, (Published Jun. 2002 Packing World, p. 11), pp. 1 and 2.

"Hillshire Farms Slices Into GladWare," Packaging Digest, Jun. 2002, p. 10.

"With Ultra-Thin Deli Select, Package Is Part of the Product," FoodEngineering, Jun. 2002, p. 22.

USPTO; U.S. Appl. No. 10/260,863; Office Action mailed Nov. 17, 2004.

USPTO; U.S. Appl. No. 10/260,863; Office Action mailed May 4, 2005.

USPTO; U.S. Appl. No. 10/260,863; Office Action mailed Dec. 2, 2005.

USPTO; U.S. Appl. No. 10/260,863; Office Action mailed Apr. 4, 2006.

USPTO; U.S. Appl. No. 10/260,863; Notice of Allowance mailed Sep. 19, 2006.

USPTO; U.S. Appl. No. 11/626,791; Office Action mailed Jun. 5, 2009.

* cited by examiner

CONTAINER FOR FOOD PRODUCTS

This application is a continuation of U.S. application Ser. No. 11/626,791, filed Jan. 24, 2007, now abandoned which is a continuation of U.S. application Ser. No. 10/260,863, filed Sep. 27, 2002, now U.S. Pat. No. 7,172,779, issued Feb. 6, 2007, all of which are incorporated in their entirety herein by reference.

FIELD OF THE INVENTION

The present invention relates generally to food packaging, and more specifically to food packages for containing pre-sliced food products.

BACKGROUND OF THE INVENTION

Many food products are often pre-sliced and packaged for sale to consumers. For example, thinly sliced food products, such as luncheon meats, are often pre-sliced and packaged in an ordered stack wherein only the first or top slice is viewed from the package exterior. In one known example, the pre-sliced stack is vacuum-sealed within a flexible bag or pouch that is either labeled or is contained within a labeled rigid container, such as a cardboard container. It is also known that such flexible packages may be made reclosable once unsealed by the consumer, such as described in U.S. Pat. No. 5,582,853 issued Dec. 10, 1996, entitled MULTI-SEAL RECLOSABLE FLEXIBLE PACKAGE FOR DISPLAYING THINLY SLICED FOOD PRODUCTS. In another example, the ordered stack is held within a rigid package formed to conform to the dimensions of the sliced and ordered stack and a lid covering the package, such as a plastic package of bologna having a cylindrical rigid base conforming to the ordered stack and a lid that covers the base.

Alternatively, thinly sliced food products are packaged such that the slices are randomly arranged or jumbled within the package. The jumbled slices, rather than lying flat on each other in an orderly stack form, lie ruffled such that there are bends and curves in the meat slices with space or air gaps present in between some of the adjacent slices. This gives the sliced food product a "freshly-sliced deli" appearance or a "fluffed" look. Many consumers prefer the fluffed look since it resembles the look of food products that are freshly sliced at the deli in comparison to the pressed meat look of traditional ordered stack packaging where the slices lie flush engagement with adjacent upper and lower slices. Such fluffed food products are typically sealed in a random arrangement within a flexible bag or pouch. Typically, the packages for containing such food products do not conform to the shape of the individual slices, as in many ordered stack packages, since the food product is not intended to look as though it has been stacked.

However, pre-sliced and fluffed food products often do not retain their fluffed look in these conventional packages. In particular, the food products tend to move, shift and settle within the package during manufacturing, distribution and storage of the packages. Additionally, flexible packages allow externally applied forces of the exterior surfaces of the packages due to handling and storage to compress portions of the fluffed product. Such action causes much of the space or air gaps present between adjacent slices to be removed. Accordingly, once on display for the consumer, these products have unfortunately lost much of their "fluff", reducing the freshly sliced appearance that is sought to be achieved by the manufacturer.

Accordingly, there is a need for a package that will result in the better retention of a desired fluffed appearance of a pre-sliced food product for display to consumers.

SUMMARY OF THE INVENTION

Embodiments of the invention provide various food packages for containing food products, such as sliced food products.

In one embodiment, the invention can be characterized as a package for containing a sliced food product, the package comprising: a compartment effective for receiving and containing slices of the food product; a bottom wall of the compartment; an opening to the compartment above the bottom wall, the opening having a substantially rectangular shape; side wall portions of the compartment upstanding from the bottom wall; and a film cover which covers and seals the opening. The side wall portions comprise: a first side wall portion having a first ramp section that extends downward and inward toward the bottom wall at a first oblique angle, the first oblique angle between about 55-75 degrees relative to a vertical axis when the package is arranged in a horizontal orientation; and a second side wall portion opposing the first side wall portion, the second side wall portion having a second ramp section that extends downward and inward toward the bottom wall at a second oblique angle, the second oblique angle between about 55-75 degrees relative to the vertical axis when the package is arranged in the horizontal orientation, wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover. The first side wall portion has a first portion extending substantially vertically downward from the first ramp section, the first portion having a first base; and the second wall portion has a second portion extending substantially vertically downward from the second ramp section, the second portion having a second base, the second base is parallel to the first base.

In another embodiment, the invention may be characterized as a package for containing a sliced food product, the package comprising: slices of the food product; a compartment effective for receiving and containing the slices of the food product; a bottom wall of the compartment; an opening to the compartment above the bottom wall, the opening having a substantially rectangular shape; side wall portions of the compartment upstanding from the bottom wall; and a film cover which covers and hermetically seals the opening. The side wall portions comprise: a first side wall portion having a first ramp section that extends downward and inward toward the bottom wall substantially uniformly at a first oblique angle, the first oblique angle between about 55-75 degrees relative to a vertical axis when the package is arranged in a horizontal orientation; and a second side wall portion opposing the first side wall portion, the second side wall portion having a second ramp section that extends downward and inward toward the bottom wall substantially uniformly at a second oblique angle, the second oblique angle between about 55-75 degrees relative to the vertical axis when the package is arranged in the horizontal orientation, wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover. The first side wall portion has a first portion extending substantially vertically downward from the first ramp section, the first portion having a first base; and the second wall portion has a second portion extending substantially vertically downward from the second ramp section, the second portion having a second base, the second base is parallel to and coplanar with the first base. The first base and the second base are parallel to the bottom wall, and the first ramp section opposes the second ramp section. The first side wall portion has a first upper section that extends substantially vertically downward from the opening to the first ramp section; and the second side wall portion has a second upper section that extends substantially vertically downward from the opening to the second ramp section. An upper edge of both the first ramp section and the second ramp section is substantially horizontal. The side wall portions each correspond to a respective side of the substantially rectangular shape of the opening, wherein the sides of the substantially rectangular shape define an x axis and a y axis; wherein the first ramp section extends downward and inward toward the bottom wall at the first oblique angle about one of the x axis and the y axis; and wherein the second ramp section extends downward and inward at the second oblique angle toward the bottom wall about the one of the x axis and the y axis.

In a further embodiment, the invention may be characterized as a package for containing a sliced food product, the package comprising: slices of a food product; a compartment effective for receiving and containing the slices of the food product; a bottom wall of the compartment which forms a horizontal base when the package is in a horizontal position and is resting on the bottom wall; a rectangular opening to the compartment above and opposite the bottom wall, the rectangular opening being larger in area than the bottom wall; side wall portions of the compartment upstanding from the bottom wall; and a film cover which covers and seals the rectangular opening. The side wall portions comprise: a first side wall portion having a first ramp section that extends downward and inward toward the bottom wall substantially uniformly at a first oblique angle between about 55-75 degrees relative to a vertical axis when the package is arranged in a horizontal orientation; wherein an upper edge of the first ramp section is substantially horizontal when the package is arranged in the horizontal orientation; a second side wall portion opposing the first side wall portion, the second side wall portion having a second ramp section that extends downward and inward toward the bottom wall substantially uniformly at a second oblique angle between about 55-75 degrees relative to the vertical axis when the package is arranged in the horizontal orientation, wherein the first ramp section opposes the second ramp section, wherein an upper edge of the second ramp section is substantially horizontal when the package is arranged in the horizontal orientation; wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover; a third side wall portion extending downward toward the bottom wall; and a fourth side wall portion extending downward toward the bottom wall and opposing the third side wall portion. The first side wall portion has a first portion extending substantially vertically downward from the first ramp section, the first portion having a first base; and the second wall portion has a second portion extending substantially vertically downward from the second ramp section, the second portion having a second base, the second base is parallel to and coplanar with the first base, wherein the first base and the second base are parallel to the bottom wall, wherein the first portion and the second portion each define a volume generally not for containing the slices of the food product. The first side wall portion has a first upper section that extends substantially vertically downward from the rectangular opening to the first ramp section. The second side wall portion has a second upper section that extends substantially vertically downward from the rectangular opening to the second ramp section. Additionally, the side wall portions each correspond to a respective side of the rectangular opening, wherein the sides of the substantially rectangular shape define an x axis and a y axis; wherein the first ramp section extends downward and inward toward the bottom wall at the first oblique angle in a first direction about one of the x axis and the y axis; and wherein the second ramp section extends downward and inward toward the bottom wall at the second oblique angle in a second direction about the one of the x axis and the y axis, the second direction being opposite the first direction.

In another further embodiment, the invention may be characterized as a package for containing a sliced food product, the package comprising: slices of a food product; a compartment effective for receiving and containing the slices of the food product; a bottom wall of the compartment which forms a horizontal base when the package is in a horizontal position and is resting on the bottom wall; a rectangular opening to the compartment above and opposite the bottom wall, the rectangular opening being larger in area than the bottom wall; side wall portions of the compartment upstanding from the bottom wall; a rim surrounding the rectangular opening and extending in a plane generally parallel to the bottom wall; and a lid which snappingly engages an upper periphery of the compartment to cover the rectangular opening. The side wall portions comprise: a first side wall portion having a first ramp section that extends downward and inward toward the bottom wall substantially uniformly at a first oblique angle between about 55-75 degrees relative to a vertical axis when the package is arranged in a horizontal orientation; wherein an upper edge of the first ramp section is substantially horizontal when the package is arranged in the horizontal orientation; a second side wall portion opposing the first side wall portion, the second side wall portion having a second ramp section that extends downward and inward toward the bottom wall substantially uniformly at a second oblique angle between about 55-75 degrees relative to the vertical axis when the package is arranged in the horizontal orientation, wherein the first ramp section opposes the second ramp section, wherein an upper edge of the second ramp section is substantially horizontal when the package is arranged in the horizontal orientation; wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover; a third side wall portion extending downward toward the bottom wall; and a fourth side wall portion extending downward toward the bottom wall and opposing the third side wall portion. The first side wall portion has a first portion extending substantially vertically downward from the first ramp section, the first portion having a first base; and the second wall portion has a second portion extending substantially vertically downward from the second ramp section, the second portion having a second base, the second base is parallel to and coplanar with the first base, wherein the first base and the second base are parallel to the bottom wall, wherein the first portion and the second portion each define a volume generally not for containing the slices of the food product. The first side wall portion has a first upper section that extends substantially vertically downward from the rectangular opening to the first ramp section. The second side wall portion has a second upper section that extends substantially vertically downward from the rectangular opening to the second ramp section. Additionally, the side wall portions each correspond to a respective side of the rectangular opening, wherein the sides of the substantially rectangular shape define an x axis and a y axis; wherein the first ramp section extends downward and inward toward the bottom wall at the first oblique angle in a first direction about one of the x axis and the y axis; and wherein the second ramp section extends downward and inward toward the bottom wall at the second oblique angle in a second direction about the one of the x axis and the y axis, the second direction being opposite the first direction.

In another embodiment, the invention can be characterized as a package for containing a food product, the package comprising at least one compartment effective for containing slices of the food product, and an opening to the compartment, the opening having a substantially rectangular shape. The package also includes a bottom wall of the compartment which forms a horizontal base when the package is in a horizontal position and is resting on the bottom wall, the opening above and opposite the bottom wall. The package further includes at least two slanted side/side walls of the compartment upstanding from the bottom wall when the package is resting on the bottom wall, the side/side walls forming at least a part of the side walls of the compartment and forming barrier walls separating the compartment and the interior of the package from outside the package; and at least one slanted side/back wall of the compartment upstanding from the bottom wall when the package is resting on the bottom wall, the side/back wall forming at least a part of the side walls of the compartment and forming a barrier wall separating the compartment and the interior of the package from outside the package. The package includes one side/front wall of the compartment extending vertically from the bottom wall when the package is resting on the bottom wall, the side/front wall forming at least a part of the side walls of the compartment and forming a barrier wall separating the compartment and the interior of the package from outside the package. A lip surrounds the opening and extends in a plane generally parallel to the bottom wall; and a lid snappingly engages an upper periphery of the compartment to close the opening. The side/front wall forms a display base where the size of the side/front wall and the lip cooperatively support the container to hold the container in a display position when the container is holding product. The two slanted side/side walls of the compartment angle upwardly and outwardly when the container is in the horizontal position, the angles being effective to push the contents of the compartment away from the side/side walls when the container is resting on the side/front wall in display position. The at least one slanted side/back wall of the container extends at an angle upwardly and outwardly when the container is in the horizontal position, the angle being effective to push the contents of the compartment away from the side/back wall and towards the opening when the container is resting on the side/front wall in display position. And the center of the bottom wall is closer to the side/front wall than to the slanted side/back wall.

In a further embodiment, the invention can be characterized as a food package for sliced food products, the package comprising: a rectangular substantially planar rigid bottom wall upon which the package rests when in a horizontal orientation; two slanted side/side walls which angularly extend upwardly from the bottom wall, each of the side/side walls forming an angle of from about 55 to about 75 degrees from vertical axes which extend orthogonally from a plane formed by the bottom wall; and a rectangular opening opposite the bottom wall, the opening being larger in area than the rectangular rigid bottom wall. The package also comprises a top side wall extending upwardly from the bottom wall; a bottom side wall extending upwardly from the bottom wall; and a flexible film which extends over the opening and seals the opening. The side walls are configured to engage the food product to hold the sliced food product, wherein each side wall is angularly ramped and extends downward and inward toward the bottom wall, and each side wall having at least one well which extends downwardly from the angularly upward extending side wall, the wells having bottom walls configured to provide stable support for the package when the package is in its horizontal orientation.

In another embodiment, the invention can be characterized as a food package for sliced food products, the package comprising: a rectangular substantially planar rigid bottom wall upon which the package rests when in a horizontal orientation; two slanted side/side walls which angularly extend upwardly from the bottom wall, each of the side/side walls forming an angle of from about 55 to about 75 degrees from vertical axes which extend orthogonally from a plane formed by the bottom wall; and a rectangular opening opposite the bottom wall, the opening being larger in area than the rectangular rigid bottom wall. The package also comprises a top side wall extending upwardly from the bottom wall; a bottom side wall extending upwardly from the bottom wall; a flexible film which extends over the opening and seals the opening; and a lid which snappingly engages the side walls and configured to close the opening. The side walls are configured to engage the food product to hold the sliced food product, wherein each side wall is angularly ramped and extends downward and inward toward the bottom wall, and each side wall having at least one well which extends downwardly from the angularly upward extending side wall, the wells having bottom walls configured to provide stable support for the package when the package is in its horizontal orientation.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

Figure 1A:
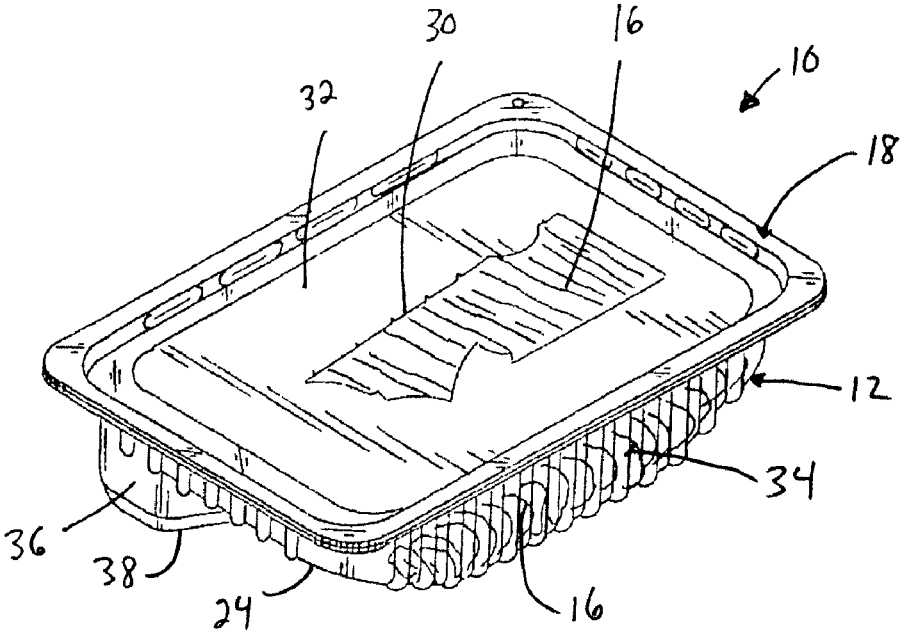
FIG. 1A is a perspective view of a food package in accordance with the present invention showing the package in its horizontal orientation.

The following description is not to be taken in a limiting sense, but is made merely for the purpose of describing the general principles of the invention. The scope of the invention should be determined with reference to the claims.

Embodiments of the present invention advantageously addresses the needs above as well as other needs by providing a food package for containing a sliced food product and that better retains a freshly-sliced or fluffed look in the food product. Preferably, the present package includes a stand-up feature that allows the fluffed sliced food product to be better displayed to the consumer than if it were lying flat on its bottom wall of its base member. In addition, the preferred package herein has a rigid-rigid construction so that additional support sleeves or the like into which the flexible packages are deposited are not needed for display purposes.

The preferred package is specifically adapted to maintain the ruffling of thin meat slices by the configuration of the compartment. Generally, the size or volume of the compartment will be carefully tailored to that of the size or volume of meat slices to be contained therein so that shifting of the packaged, fluffed or ruffled meat slices is minimized during movements of the package. To this end, the walls of the compartment are configured to engage and bias the meat in a predetermined manner for keeping the bends or ruffles in the deli-meat slices despite package handling and the like.

More particularly, the compartment has sidewalls extending between the bottom and top of the package in an other than vertical orientation. At least one, and preferably several of the sidewalls can be provided with an inward taper toward each other as they progress toward the bottom of the compartment. In other words, one or more of the side walls include taper sections or ramp sections. Accordingly, only some of the meat slices are funneled downwardly to take up the smaller space or volume present toward the bottom of the compartment with the majority of the volume of meat slices kept held or propped up toward the upper end of the compartment which presents the meat slices with progressively greater volume in which to fit. Thus, only the relatively few meat slices at the container bottom will be subject to significant compression forces from above that can eliminate the fluffing therein, while the great majority of the slices supported on these bottom slices will retain their fluffy look.

The taper of the compartment side walls is at a relatively large angle to the vertical such that the bottom wall is of small size relative to the upper compartment opening. Accordingly, the space in the compartment widens or increases fairly quickly from the bottom up. Because of this taper of the sidewalls, there will only be a relatively small amount of meat funneled to the bottom of the compartment in the confined space thereat. As such, most of the meat in the compartment will be provided with enough space so that the slices are not compressed. In particular, since the preferred package herein is constructed to provide a viewing window through the cover to the contents of the compartment as described hereinafter, it is the meat slices at or adjacent to the top of the compartment in which the fluffy look thereof is most important. Thus, the tapered compartment as described above enables meat slices to retain their fluffed look at locations in the compartment that are most important from a point-of-sale perspective. Additionally, the preferred package is also configured such that the meat slices retain the fluffed appearance along the edges of the compartment since the meat slices are viewable through the sides of the tapered compartment, i.e., the sides of the preferred compartment are also important from a point-of-sale perspective.

At the same time, this progressively increasing space is sized to closely match that of the volume of meat to be received therein so that the meat will be held between the sidewalls and the cover against shifting which can cause the meat slices to lose their fluffiness. As mentioned, the tapered sidewalls provide the meat slices with a slight upward bias toward the cover so that they are lightly held therebetween. This retains the fluffed slices substantially stationary in the compartment so that they do not move and push against each other such as when the package is being handled. In the preferred form, three compartment sidewalls are tapered as described and the fourth side wall extends substantially vertically between the bottom wall and the upper opening at the forward side of the compartment, for reasons described hereinafter.

In another aspect of the invention, the package is adapted to be self-standing in a generally vertical, display orientation with the bottom wall of the meat compartment extending upwardly from a surface on which the package is supported. As previously mentioned, the preferred package has the front side wall portion of the compartment configured to extend substantially normal to the compartment bottom wall. This side wall extends for a predetermined distance so as to space the juncture between it and the bottom wall, and the front portion of a transverse upper lip of the base member by a distance sufficient to allow them to cooperate to keep the package in its display orientation. Herein, the display orientation is typically referred to as being vertical although it will be understood that this can include a slight rearward incline of the self-standing package herein. This vertical display orientation provides the benefit that the package may be displayed on the retailer's shelf such that consumers can easily view the product through the viewing window(s) of the cover or lid. Advantageously, special merchandisers are not required for display since the packages may simply be turned in a vertical orientation and placed on a shelf for display.

The compartment is positioned toward the front of the base member so that when the package is pivoted up approximately ninety degrees from the horizontal orientation thereof to the vertical orientation, the center of gravity of the package loaded with relatively heavy, fluffed sliced meat, e.g. deli ham or turkey slices, is shifted downwardly to provide the package with stability in it self-standing, display orientation. To this end, the geometric center of the rectangular bottom wall can be displaced toward the front of the package relative to the center of the rectangular upper end thereof. With the previously-described preferred small size of the bottom wall for meat fluffing purposes, the rear edge of the compartment bottom wall can be displaced forwardly of the package center, as well.

The tapered opposite side wall portions of the compartment on either side (or rectangular ends) of the base member also act to push the meat slices inward from the sides toward the vertical center line of the package. The taper of the rear side wall portion generally cooperates with the normal front side wall portion to push the meat slices forwardly toward alignment with the center of the bottom wall. As mentioned, this positioning of the compartment as well as the tapered configuration of the compartment rear side wall shifts the weight of the meat forwardly in the compartment so that the center-of-gravity of the package is lower when the package is pivoted to stand on its forward side for display.

Another effect that the tapered configuration of the side wall portions provides is to push or bias the meat slices upwardly in the compartment as the volume of the compartment progressively enlarges toward the upper end thereof, as has been mentioned. Again, when pivoted for display, this lifting action on the meat slices will cause the weight of the meat to be shifted forwardly in the vertically oriented package. Since in its generally vertical orientation, the package preferably is slightly tilted rearward to rest on the corner juncture of the front and bottom compartment walls, this forward weighting of the package further assists in stabilizing it for display. Thus, the forward position of the compartment and the taper of the compartment side walls cause the center-of-gravity of the vertically oriented package to be lowered and shifted toward the front of the package, so that the package is more resistant to tipping and falling over when pivoted to its display position.

The taper of the compartment rear side wall and the lack of such a taper on the forward side wall are such that the center of the bottom wall is shifted forwardly in the package, as previously discussed. The rear side wall portion can be tapered such that not only is the bottom wall off-center, but so that its rear edge is also disposed forwardly of the base center. In one form, the rear side wall can be more gradually tapered than the tapered opposite side wall portions, and it can be provided with a longer length in its tapering direction so as to position and shift the bottom wall forwardly in the package, as has been described.

The package, and specifically the base member thereof is also adapted to shift the center-of-gravity of its contents as described above for being oriented vertically for display purposes, while maintaining the stability of the packages in their horizontal orientation. More particularly, the base member has wells or foot portions formed at either rear corner that serve as feet for the base when horizontally disposed, e.g., stored in a distribution truck, retailer storage shelf or a consumer refrigerator. The space in the wells is significantly less than that in the main compartment in which the meat slices are received. Thus, any meat that may be located in the wells is also kept to a minimum.

When the package is pivoted to its display orientation, the wells will be toward the top of the package. Because the weight of the material used for the well walls is small relative to the weight of the meat slices, the wells do not cause the package to be top heavy in the vertical position which otherwise can cause undesired instability and tipping problems. At the same time, the wells are formed to approximately the same depth as the main compartment so that their bottom walls are aligned (preferably coplanar with) with that of the main compartment to provide stable support for the base member in its horizontal orientation.

The taper of the opposite side wall portions of the main compartment spaces the opposite side or end edges of the rectangular compartment bottom wall inwardly from the corresponding side or ends of the base member at the upper periphery thereof. Further, the tapered rear side wall portion spaces the compartment bottom wall forwardly in the base member. Accordingly, the bottom wall of the food compartment is disposed intermediate the bottom walls of the rear corner wells and forwardly therefrom so that the three bottom walls are arranged in a triangular orientation relative to each other. This triangular spacing or arrangement of the bottom walls provides a secure tripod support for the base in its horizontal position. Additionally, the rear wells are shaped to nest within the lid of adjacent packages in a horizontal stack for reducing side-to-side movement of packages within a stack, while the front wall nests into the lid of adjacent packages in the horizontal stack together with the rear wells for reducing front-to-back movement of the packages within the stack.

In accordance with several embodiments of the present invention, a food package for sliced food products is provided that includes a rigid tray or base member forming a compartment for containing the food product and a rigid cover or rigid lid sealing the compartment. Advantageously, the base member includes a bottom wall and side wall portions upstanding therefrom that are configured to engage and hold the food product within the compartment such that it will minimize shifting and movement of the product within the compartment; thus, better retaining the fluffed looked upon display for the consumer. Preferably, the food package is generally rectangularly shaped in a plan view.

Additionally, in another feature, the rigid lid hermetically seals against the rigid base member at sealing surfaces extending about the opening of the compartment. Advantageously, due to this hermetic seal, the food product is not required to be sealed within a flexible bag or pouch within the rigid tray/rigid lid. This feature also reduces packaging costs, saves packaging material and eliminates steps in the assembly process. Additionally, according to one embodiment, once the lid is unsealed by the consumer, the lid may be re-closed into the compartment to provide easy storage of the food package in the consumer's refrigerator. Thus, the consumer is not required to provide another container or bag to store the food product.

Furthermore, since the base member and lid are generally rigid, normal externally applied forces on the surfaces of package do not affect or compress the product within. All of this helps to maintain a fluffed look to the consumer.

Figure 1B:
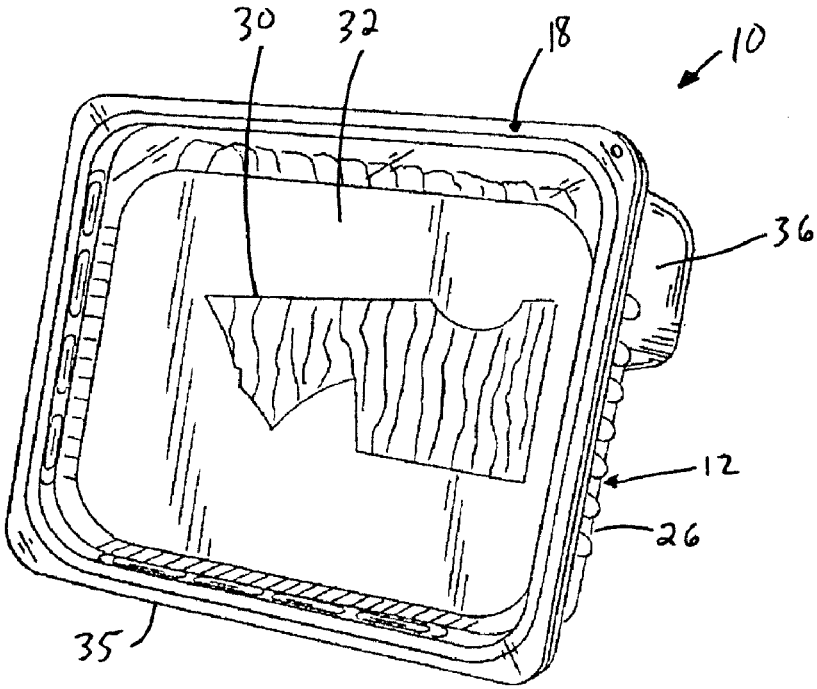
FIG. 1B is a perspective view of the food package of FIG. 1A shown in a vertical standup orientation for displaying the food product, for example, on a display shelf.
Figure 2:
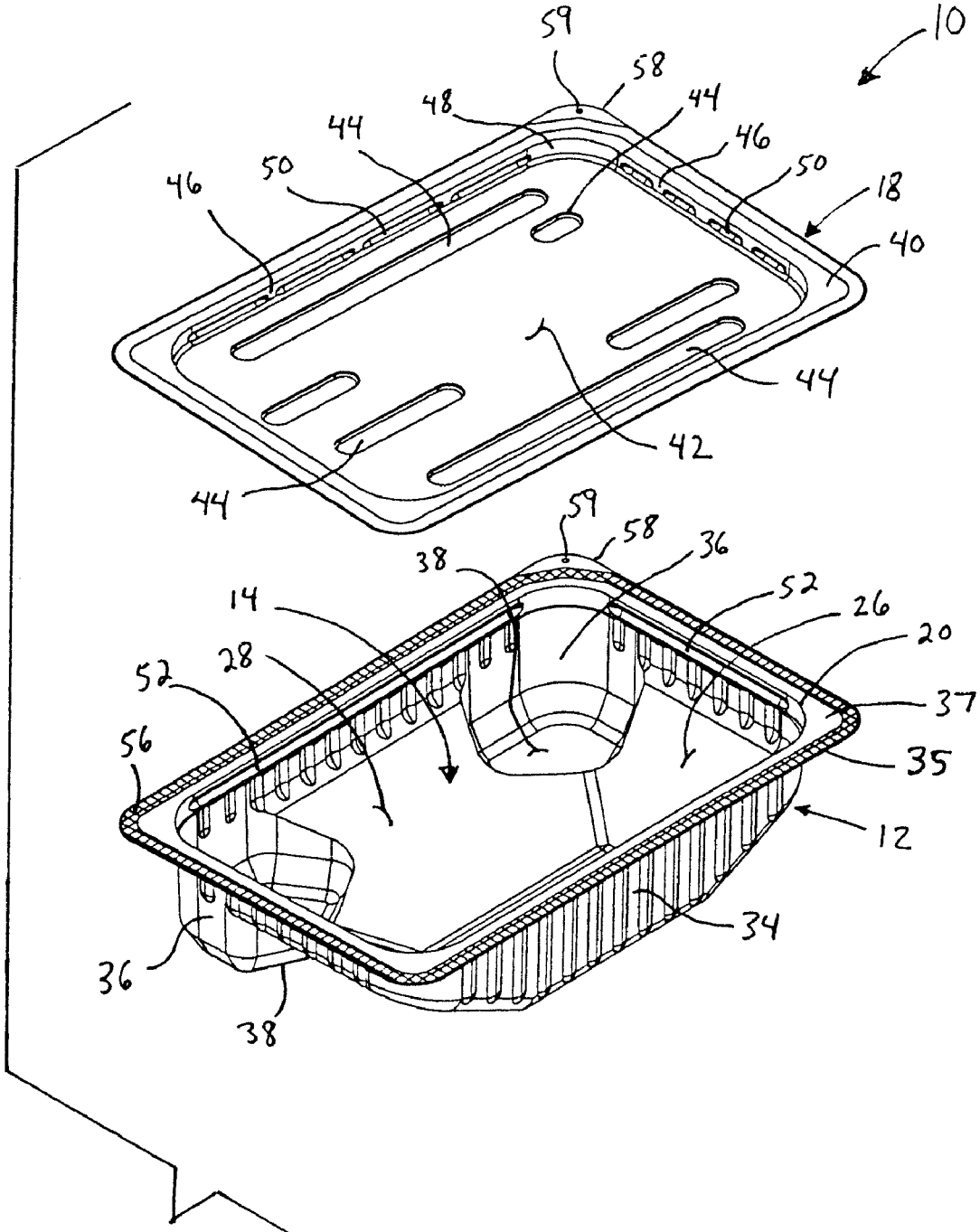
FIG. 2 is an exploded perspective view of the food package of FIGS. 1A and 1B, illustrating a rigid base member and a rigid lid for closing the base member.

Several embodiments of the present invention are generally directed to food packages 10 in which there is a molded tray or base member 12 having a compartment 14 formed therein as by thermoforming for receipt of food products 16 such as sliced food products, preferably arranged to have a "fluffed" appearance, such as sliced luncheon meats, as shown in FIGS. 1A, 1B and 2. As used throughout this specification, the term fluffed refers to the seemingly disorganized or random arrangement of a sliced food product, such as it may appear as it "falls off of a slicer" into a pile. Thus, a fluffed sliced food product includes food product that is piled, jumbled or stacked in a random or stacked-to-look-random arrangement. Additionally, the sliced food product may be sliced at a variety of thicknesses depending on the specific type of product, e.g., preferably, the food product is a meat product that is thinly sliced or "shaved" between about 0.035 to 0.055 inches thick, most preferably, about 0.045 inches thick. However, in other forms the slices may be thicker depending on the type of food product and fluffed look to be achieved, for example, up to 0.8 inches thick. The food package further includes a cover or lid 18 formed by thermoforming for example, that covers and is hermetically sealed to an opening 20 of the compartment 14 of the base member 12. The lid 18 is designed to be opened (thus, unsealed) by the consumer and is then reclosable into the opening 20. Preferably, the lid 18 and the base member 12 are made of a clear or at least partially transparent material such that the food product 16 is visible through the food package 10.

As can be seen in FIGS. 1A, 1B, 2 and 3, the base member 12 includes a base or bottom wall 22 and side wall portions 24, 26 and 28 that have a predetermined configuration to engage and hold the food product within the compartment 14 such that it will minimize shifting and movement of the product within the compartment 14; thus, better retaining the fluffed looked of the food product 16 upon display for the consumer. In many embodiments, the side wall portions 24, 26 and 28 extend vertically downwardly from a ridge of the opening of the compartment a distance, then extend downwardly and inwardly toward the bottom wall 22 at an oblique angle. Thus, the side wall portions have angled or inclined taper or ramp sections and are best seen as ramp sections 62, 64 and 68 of FIGS. 7-8. These ramp sections function to push or hold the food product 16 contained within the compartment 14 upward toward the lid 18 and inward toward the center of the compartment 14. Advantageously, this provides better viewing of the food product 16 through a window 30 of a label 32 adhered or otherwise placed over the lid 18. Furthermore, these side wall portions also function to further retain the fluffed food product within the tapered compartment 14 formed by the bottom wall 22 and the various side wall portions 24, 26, 28, minimizing shifting or movement of the food product 16 during distribution, storage and display. The angled side wall portions 24, 26, 28 are best viewed in FIGS. 4A-6.

Herein, the orientation of the package surfaces and components will normally be referenced to the FIG. 1A in a horizontal position of the package 10. The horizontal orientation is typically used in the storage of the food package 10, such as in a retailer's, distributor's or consumer's refrigerator. However, as is illustrated in FIG. 1B, the package 10 is adapted to be rotated ninety degrees to stand on end or edge for display. Thus, the orientation of FIG. 1B is referred to as a stand-up orientation or a display orientation. As described herein, the horizontal orientation of FIG. 1A will generally be used as reference for the description of the package surfaces or walls and its components or contents.

It is also noted that while the construction of the food package 10 herein is the preferred form, it is manifest that the package 10 can take on other configurations from those illustrated and described herein. For example, in various forms, the base member 12 may have multiple compartments. Taper or ramp sections of the side wall portions may extend a portion of the length of the side wall portion, or extend a full length of a side wall portion. Likewise, the ramp sections of the respective side wall portions may extend toward and transition to the bottom wall 22 or may extend toward the bottom wall but separated from the bottom wall by an intermediate side wall section, such as a bottom ledge or similar section extending upward from the bottom wall. Additionally, although the food package 10 is illustrated in a generally rectangular geometry, the food package 10 may take on other geometries consistent with the present invention. Furthermore, one or more of the lid 18 and base member 12 may not be made of a clear material. In another alternative, the cover or lid can be in the form of a thin, flexible film sealing the compartment 14 of the base member 12, although the rigid lid 18 is preferred for being re-closable onto the base member 12, as described hereinafter.

In contrast to known containers for sliced food products, the package described herein is a generally rigid base member 12 and a generally rigid lid 18 design, for example, constructed of a thermoformed plastic material. Thus, the food package is a rigid-rigid design. Since the lid 18 is hermetically sealed into the opening 20 of the compartment 14, the sliced food product 16 is not required to be further contained and sealed within a flexible bag or pouch within the compartment 14. This feature reduces packaging costs, saves packaging material and eliminates steps in the assembly process. Additionally, this feature allows for easier access to the food product by the consumer, i.e., the consumer only has to open the lid 18 and does not have to open or unseal a further container or pouch within the package. Thus, in many embodiments, the food product 16 contacts and is retained within the compartment 14 by the interior surfaces of the base member 12 and the lid 18. Furthermore, since the base member 12 and the lid 18 are generally rigid, normal externally applied forces to the surfaces of the package do not act to compress the product 16 within; thus, better preserving the desired fluffed look of the food product 16 for the consumer.

Figure 3:
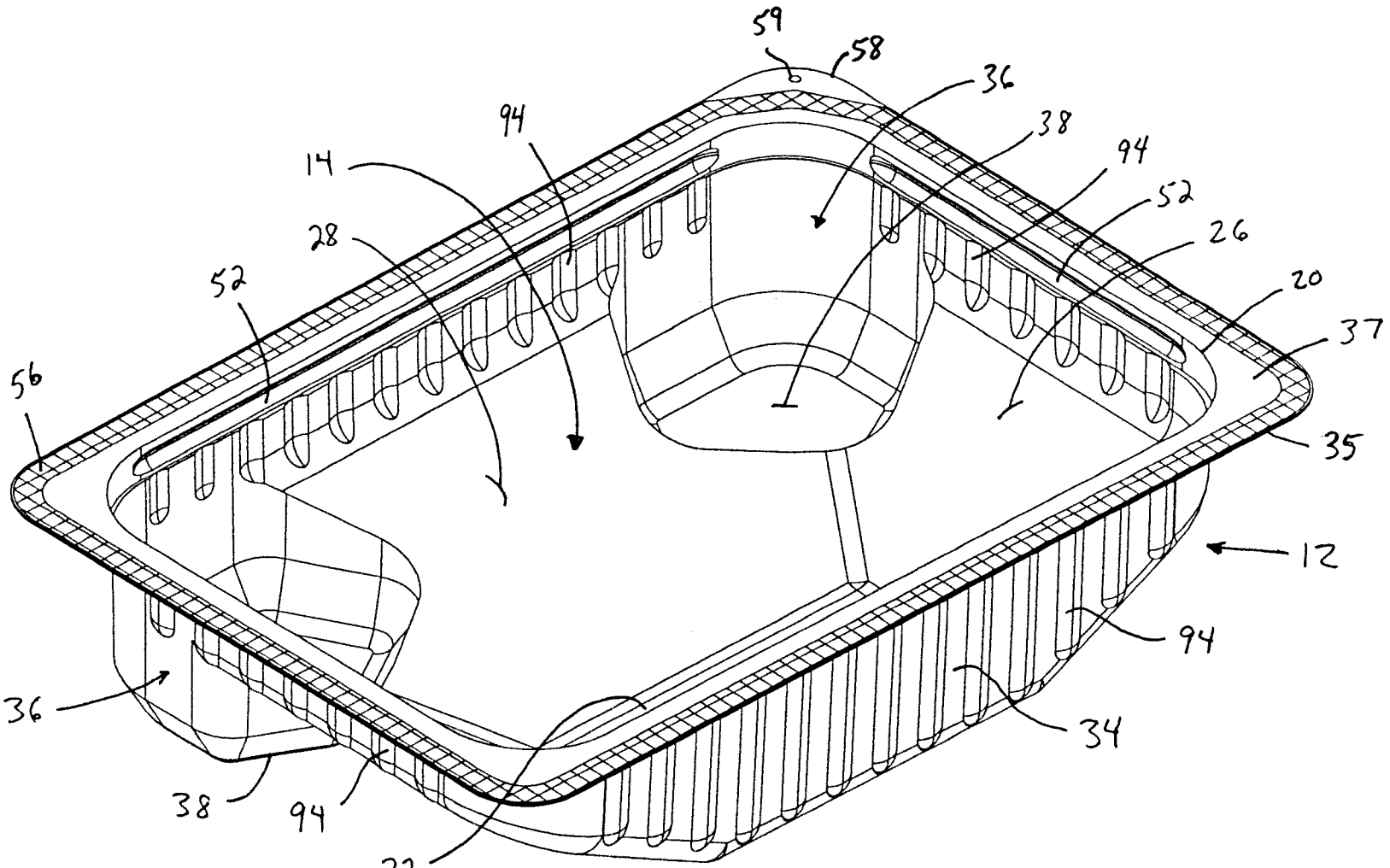
FIG. 3 is a perspective view of the base member of the food package of FIG. 1 illustrating angled side wall portions, a vertically extending front side wall portion, and wells or foot portions for stabilizing the food package in its horizontal orientation.

Also, as illustrated in FIGS. 1A, 2 and 3 for example, a front side wall portion 34 of the rigid base member 12 forming a front side of the compartment 14 extends generally vertically from the opening 20 to the bottom wall 22, i.e., the front side wall portion 34 is generally normal to the bottom wall 22. Accordingly, the package 10 is designed to be stood-up or tipped on the edge on the front side wall portion 34. Thus, the package 10 rests on a front edge 35 of the package 10 and a support surface 108 (see FIG. 15) of the front side wall portion 34 in the vertical or stand-up orientation illustrated in FIG. 1B. In the preferred form, the support surface 108 is the portion of the front side wall portion 34 at the junction of the front side wall portion and the bottom wall 22, such that the bottom wall 22 extends substantially vertically while in the display orientation. This provides the benefit that the package 10 may be displayed on the retailer's shelf in a display orientation such that consumers will advantageously view the product 16 through the viewing windows 30 through the rigid lid 18. Advantageously, special merchandisers are not required for display since the package 10 may simply be turned in a vertical orientation and placed on a shelf for display. It is noted that the front side wall portion may also extend downward and inward (or outward) at a slight angle toward the bottom wall 22 in some embodiments (i.e., the front side wall portion 34 may be other than normal with the bottom wall 22) and still be adapted to stand up.

Also illustrated, the rear side wall portion 28 opposite the front side wall portion 34 includes a ramp section that extends vertically downward and inward to the bottom wall 22 at an oblique angle. Thus, the ramp section of the rear side wall portion 28 extends downward and tapers inward toward the bottom wall 22. This inwardly tapering or ramping rear side wall portion not only functions to lift and hold the food product upwardly in the horizontal orientation, it also serves to hold or push the food product toward the center of the compartment 14 in the horizontal orientation, preferably in alignment over the bottom wall 22. In this embodiment, since the front side wall portion 34 extends generally vertically from the opening 20, the food product is pushed toward the center of the bottom wall 22 by the angled rear side wall portion. This effectively lowers the center of gravity of the package 10 when in the standup display orientation of FIG. 1B (i.e., the center of gravity is moved towards the front side wall portion 34, see also FIG. 15). Additionally, since the product is lifted, the center of gravity of the food package is also shifted slightly toward the lid in the vertical display orientation. These functions help to stabilize the food package 10 during the display orientation minimizing the risk that the package 10 will topple over.

Figure 16:
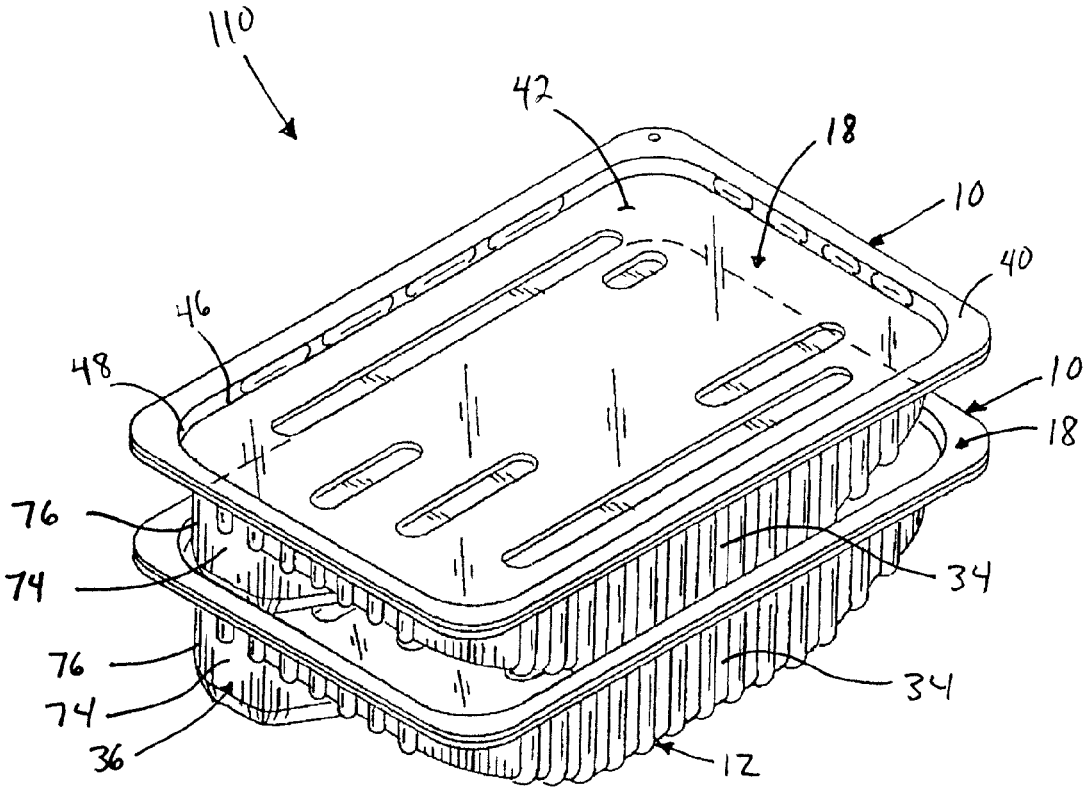
FIG. 16 is a perspective view of two food packages described herein stacked in the horizontal storage orientation illustrating the nesting of the foot portions and the front side wall portion within the lids within a stack of food packages to enhance stability and reduce lateral movement of individual packages within the stack.

Further illustrated, an additional feature provides a well-like foot portion 36 (also referred to as wells or well portions) formed at the junction of the rear side wall portion 28 and a respective adjacent side wall portion 24, 26 of the rigid base member 12. Each foot portion 36 extends vertically from the opening 20 to a respective base portion 38, which is generally horizontally coplanar with the bottom wall 22. Advantageously, the foot portion(s) 36 provide stability to the food package 10 when the stacked in the horizontal or storage orientation of FIG. 1A, e.g., stored in a distribution truck, retailer storage shelf or a consumer refrigerator. Such foot portions 36 are especially useful since the angled rear side wall portion 28 functions to shift the center of gravity of the food package 10 toward the lid 18 and the front side wall portion 34, without the foot portions 36, the package is less stable. In particular, multiply stacked food packages 10 in the horizontal orientation, such as would be during distribution and storage, are considerably less stable and will topple over. The foot portions 36 minimize such toppling but do not take away from the functionality that the angled rear side wall portion 28 provides by pushing the product 16 toward the center of the bottom wall 22 and upward toward the lid 18 of the food package 10. Additionally, as illustrated in FIG. 16, the feet portions 36 and the front side wall portion 34 are shaped to nest within the lid 18 of adjacent packages 10 in a horizontal stack; thus, reducing lateral or horizontal movement (e.g., side-to-side and front-to-back movement) of packages 10 within a stack.

Referring next to FIGS. 4A-8 as they relate to FIGS. 1A-3, more details surrounding the design of the base member and the compartment 14 formed therein are described. For example, in FIG. 4A, the orientation of the bottom wall 22 in relation to the center of the base member 12 is illustrated. As can be seen, due to the side wall portions 24, 26 and 28 extending downward and inward toward the bottom wall 22 at an oblique angle, a center 99 of the rectangularly shaped bottom wall 22 is positioned closer to the front of the package, and more particularly closer to the front edge 35 of the transverse upper ridge portion 37 extending about the perimeter of the upper end of the package 10. In the illustrated form, the rear edge 96 of the bottom wall 22 is located on the front side of the center 98 of the profile of the base member 12.

The preferred base member 12 of FIGS. 4A-8 is specifically adapted to maintain the ruffling of thin meat slices by the configuration of the compartment 14. Generally, the size or volume of the compartment 14 is carefully tailored to that of the size or volume of meat slices to be contained therein so that shifting of the packaged, fluffed or ruffled meat slices is minimized during movements of the package. To this end, the side wall portions 24, 26, 28, 34 of the compartment 14 are configured to engage and bias the meat in a predetermined manner for keeping the bends or ruffles in the deli-meat slices despite package handling and the like.

The side wall portions 24, 26, 28 of the compartment 14 are upstanding from the bottom wall 22 and extend between the bottom and top of the package 10 in an other than vertical orientation. At least one, and preferably several of the side wall portions are provided with an inward taper toward each other as they progress toward the bottom wall 22 of the compartment 14. Accordingly, only some of the meat slices are funneled downwardly to take up the smaller space or volume present toward the bottom of the compartment 14 with the majority of the volume of meat slices kept held or propped up toward the upper end of the compartment 14 which presents the meat slices with progressively greater volume in which to fit. Thus, only the relatively few meat slices at the container bottom will be subject to significant compression forces due to gravity from above that can eliminate the fluffing therein, while the great majority of the slices supported on these bottom slices will retain their fluffy look.

Figure 4A:
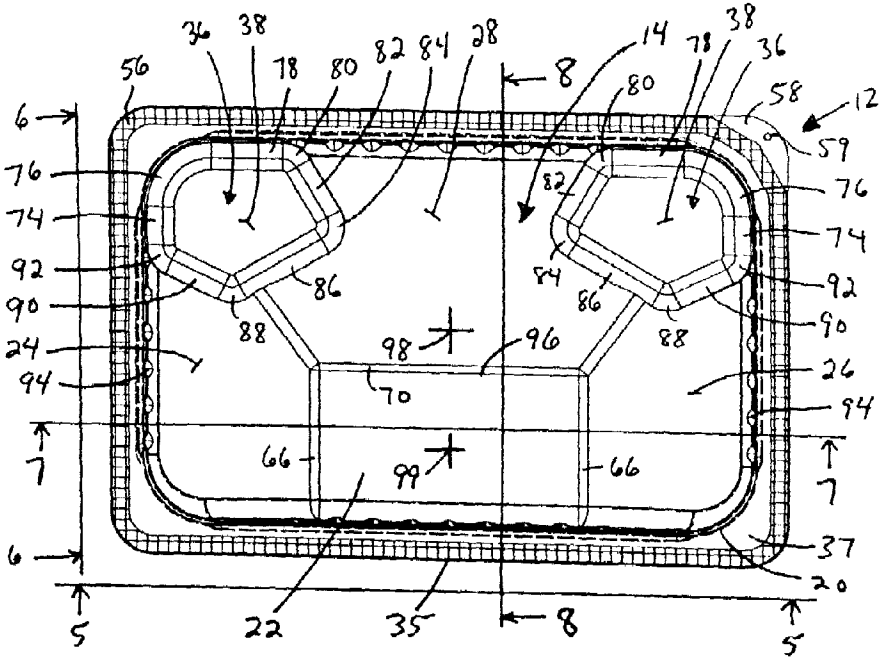
FIG. 4A is a plan view of the base member of FIG. 3 illustrating a bottom wall from which the angled side wall portions extend upwardly and the foot portions at adjacent corners of the base member spaced apart from the front side wall portion.

The taper of the compartment side walls 24, 26, 28 is at a relatively large angle to the vertical such that the bottom wall 22 is of small size relative to the upper compartment opening, which is best illustrated in FIG. 4A. Accordingly, the space in the compartment 14 widens or increases fairly quickly from the bottom up (see the perspective view of FIG. 3). Because of this taper of the side wall portions 24, 26, 28, there will only be a relatively small amount of meat funneled to the bottom of the compartment 14 in the confined space thereat. As such, most of the meat in the compartment 14 will be provided with enough space so that the slices are not compressed. In particular, since the preferred package herein is constructed to provide a viewing window through the cover or lid to the contents of the compartment 14, it is the meat slices at or adjacent to the top of the compartment 14 in which the fluffy look thereof is most important. Thus, this tapered compartment 14 as described above enables meat slices to retain their fluffed look at locations in the compartment 14 that are most important from a point-of-sale perspective.

At the same time, this progressively increasing space of the compartment 14 is sized to closely match that of the volume of meat to be received therein so that the meat will be held between the side wall portions 24, 26, 28, 34 and the lid 18 against shifting which can cause the meat slices to lose their fluffiness. As mentioned, the tapered side wall portions 24, 26, 28 provide the meat slices with a slight upward bias toward the lid 18 so that they are lightly held therebetween. This retains the fluffed slices substantially stationary in the compartment 14 so that they do not move and push against each other such as when the package is being handled. In the preferred form, three compartment side wall portions 24, 26, 28 are tapered as illustrated (e.g., include ramp sections as described below) and the front side wall portion 34 extends substantially vertically between the bottom wall 22 and the upper opening at the forward side of the compartment.

Figure 15:
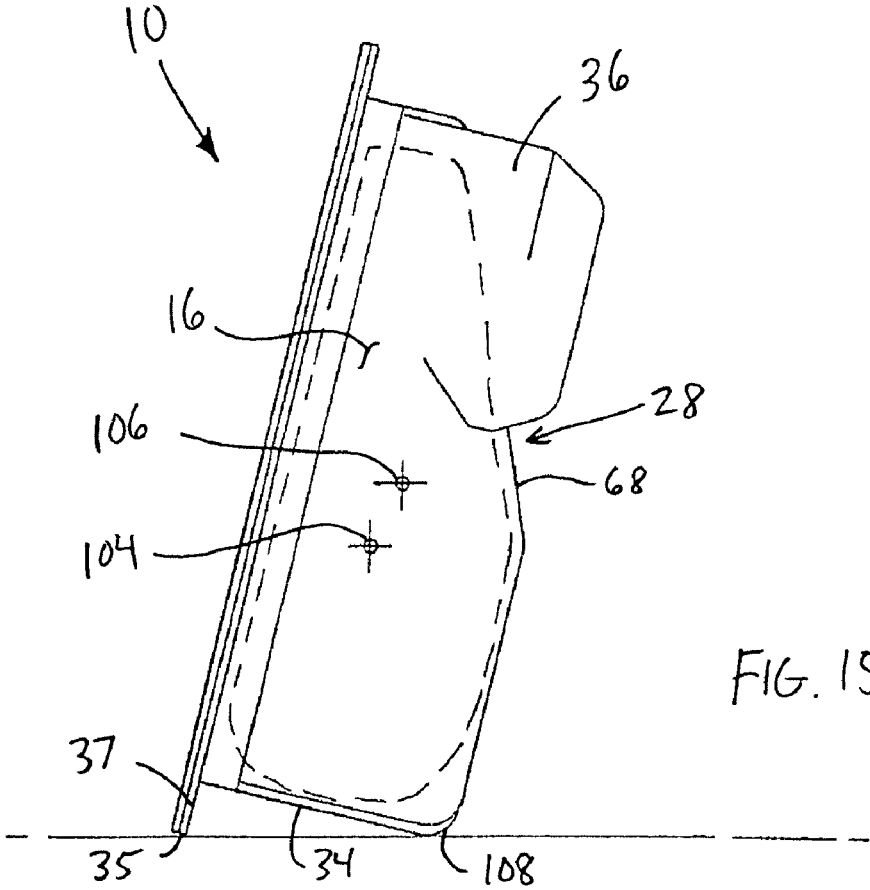
FIG. 15 is a schematic view of the food package including the rigid lid and containing the food product, illustrating the functionality of the ramp section of the rear side wall portion in lowering the center of gravity of the food package and the food product when the food package is in the vertical or display orientation of FIG. 1B.

As described above, the package is adapted to be self-standing in a generally vertical, display orientation with the bottom wall 22 of the meat compartment extending upwardly from a surface 108 on which the package is supported (see FIG. 15). As previously mentioned, the preferred package has the front side wall portion 34 of the compartment configured to extend substantially normal to the compartment bottom wall. The front side wall portion 34 extends for a predetermined distance so as to space the juncture between it and the bottom wall 22, and the front portion or front edge 35 of a transverse upper ridge portion 37 of the base member by a distance sufficient to allow them to cooperate to keep the package in its display orientation. Additionally, the predetermined distance is designed relative to the volume of the food product to be contained within the compartment. Herein, the display orientation is typically referred to as being vertical although it will be understood that this can include a slight rearward incline of the self-standing package herein. This vertical display orientation provides the benefit that the package may be displayed on the retailer's shelf such that consumers can easily view the product through the viewing windows of the cover or lid. Advantageously, special merchandisers are not required for display since the packages may simply be turned in a vertical orientation and placed on a shelf for display.

As illustrated in FIG. 4A, the compartment 14 is positioned toward the front of the base member 12 so that when the package 10 is pivoted up approximately ninety degrees from the horizontal orientation thereof to the vertical orientation, the center of gravity of the package loaded with relatively heavy, fluffed sliced meat, e.g. deli ham or turkey slices, is shifted downwardly to provide the package with stability in it self-standing, display orientation. To this end, the geometric center 99 of the rectangular bottom wall 22 is displaced toward the front of the base member 12 relative to the center 98 of the rectangular upper end of the package 10. With the preferred small size of the bottom wall 22 for meat fluffing purposes, the rear edge 96 of the compartment bottom wall 22 can be displaced forwardly of the package center 98, as well.

Figure 5:
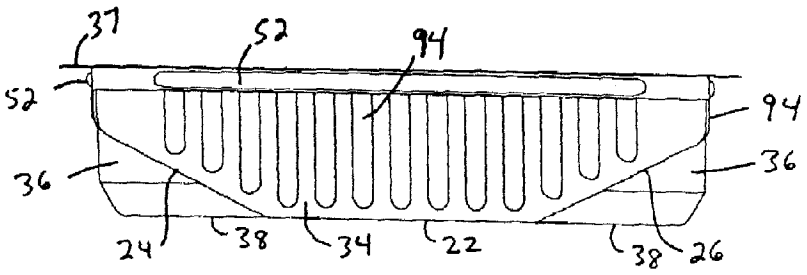
FIG. 5 is an elevational view taken along line 5-5 of FIG. 4A showing the alignment of the bottom wall with the bottoms of the foot portions for supporting the package in its horizontal orientation.
Figure 7:
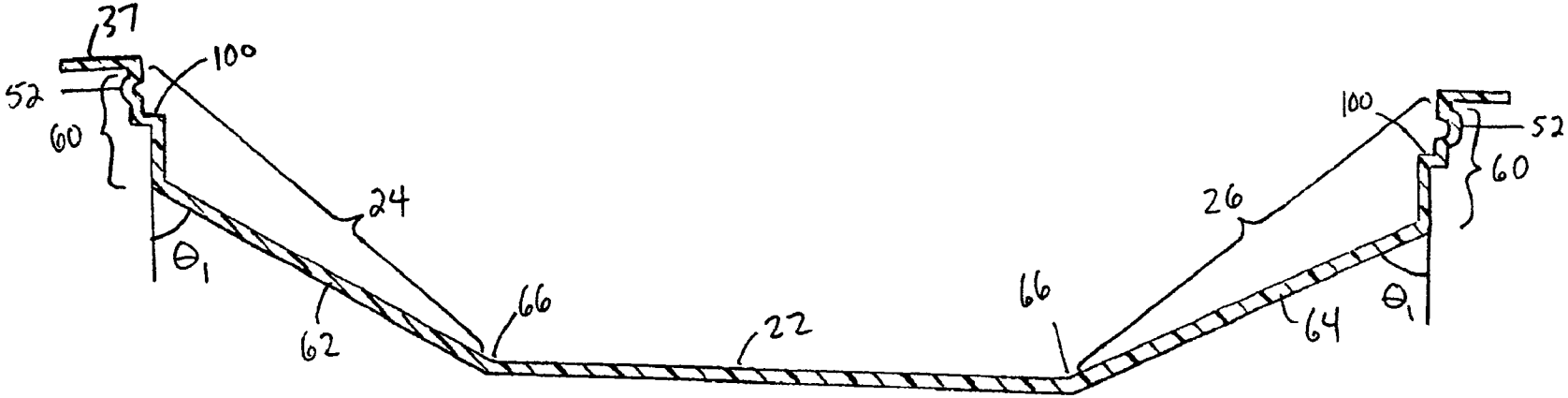
FIG. 7 is a cross sectional view of the base member taken along line 7-7 of FIG. 4A illustrating the configuration of upper sections and ramp sections of the side wall portions relative to a bottom wall.

FIGS. 5 and 7 better illustrate the configuration of the inwardly tapering side wall portions 24 and 26 upstanding from the bottom wall 22. As best seen in the cross sectional view of FIG. 7, the upper section 60 of the side wall portion 24 extends generally vertically downward from the opening of the ridge 37 of the base member 12. The upper section 60 then transitions to a ramp section 62 which extends generally downward and inward at an oblique angle (e.g., angle $\theta_1$ relative to a vertical axis) toward the bottom wall 22. A bottom section 66 transitions the ramp section 62 to the bottom wall 22. Likewise, the upper section 60 of the side wall portion 26 extends generally vertically downward from the opening of the ridge 37 of the base member 12. The upper section 60 then transitions to a ramp section 64 which also extends generally downward and inward at an oblique angle (e.g., angle $\theta_1$) toward the bottom wall 22.

Again, the angled ramp sections 62 and 64 of the side wall portions 24 and 26 function act to push the meat slices inward from the sides toward the vertical center line of the compartment 14. Furthermore, the ramp sections 62 and 64 act to push or bias the meat slices upwardly in the compartment 14 as the volume of the compartment progressively enlarges toward the upper end of the compartment 14. This positions the food product closer to the lid and increases the viewability of the food product through the windows 30 of the lid 18. Additionally, these ramp sections 62 and 64 function to better contain the food product within the compartment in order to minimize movement of the product, thus, advantageously, better preserving the fluffed look of sliced food products. For example, the ramp sections 62 and 64 reduce the side-to-side movement of the food product within the compartment 14.

The vertically dropping upper sections 60 function to provide structural stability to the base member 12, which is important to minimize package abuse during distribution. The upper sections 60 also provide a volume within which the lid 18 will nest into. Additionally, as is described below, each upper section 60 includes a recess 52, which is part of a re-closing mechanism that is adapted to snap fit together with corresponding lugs 50 of the lid 18. As also illustrated in FIG. 7, the upper sections 60 include a horizontal ledge 100 such that the of the upper section 60 extends downward then inward the length of the horizontal ledge 100, then continues to extend downward until it further transitions to the appropriate ramp section 62, 64. The horizontal ledge 100 defines vertical support channels 94 for structural support and assisting in the gas flushing of the compartment as described below.

Figure 6:
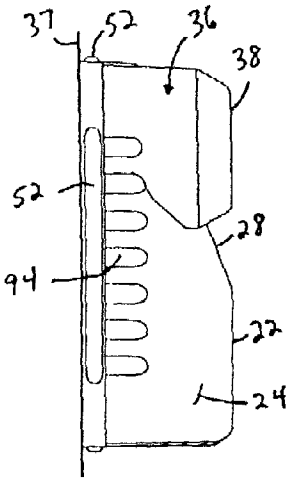
FIG. 6 is an end elevational view taken along line 6-6 of FIG. 4A illustrating the configuration of the angled rear side wall portion.
Figure 4B:
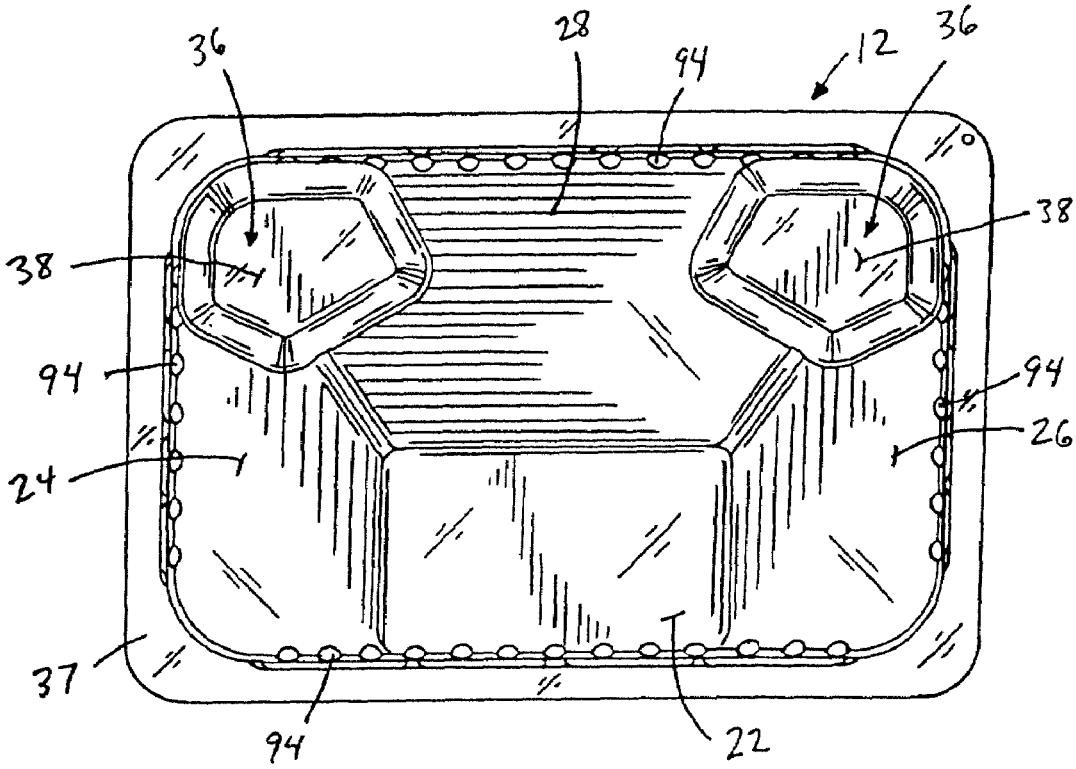
FIG. 4B is a bottom view of the base member of FIG. 4A illustrating a tripod support formed by the bottom wall and the foot portions.
Figure 8:
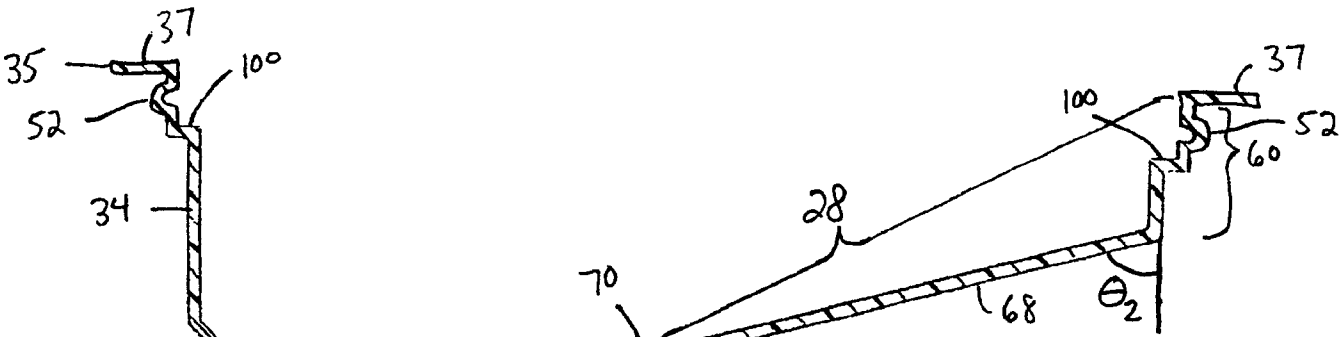
FIG. 8 is a cross sectional view of the base member taken along line 8-8 of FIG. 4A illustrating the configuration of an upper section and a ramp section of the rear side wall portion relative to the bottom wall.
Figure 9:
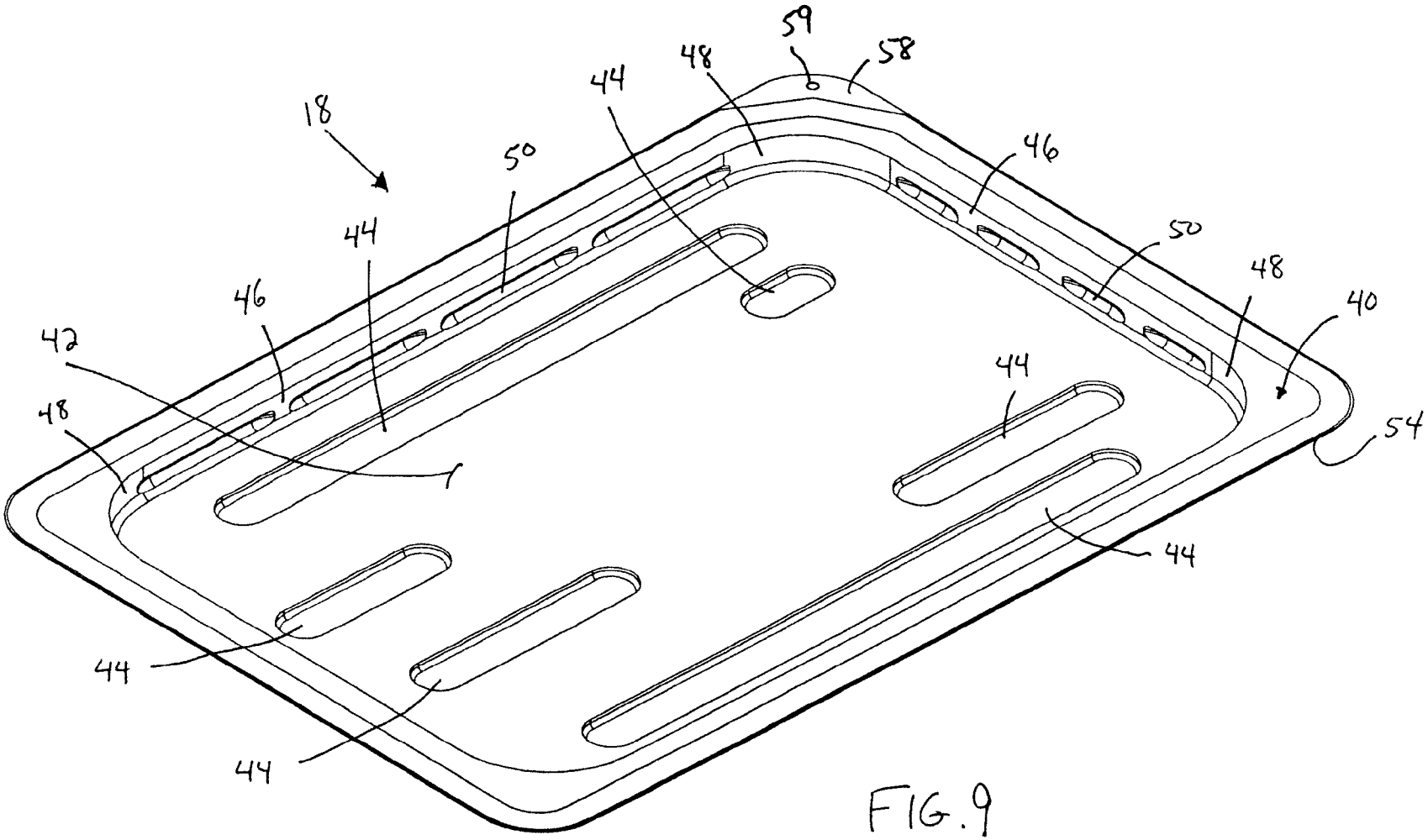
FIG. 9 is a perspective view of the rigid lid of FIG. 2 illustrating a ridge portion, vertically extending lid walls, a lid cover wall, lugs adapted to fit into the base member for a snap fit and flat channels for structural stability.
Figure 11:
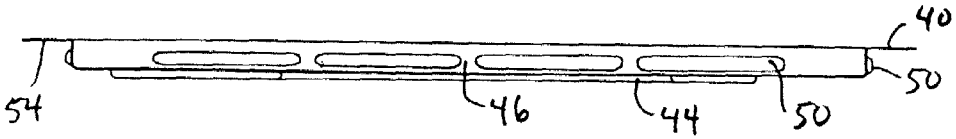
FIG. 11 is an elevational view taken along line 11-11 of FIG. 10 illustrating the lugs for reclosing the lid once unsealed.

FIGS. 6 and 8 better illustrate the configuration of the inwardly tapering rear side wall portion 28 and the front side wall portion 34 upstanding from the bottom wall 22. As best seen in the cross sectional view of FIG. 8, the upper section 60 of the rear side wall portion 28 extends generally vertically downward from the opening of the ridge 37 of the base member 12. The upper section 60 also includes a horizontal ledge 100 as described below and then transitions to a ramp section 68 which extends generally downward and inward at an oblique angle (e.g., angle $\theta_2$ relative to a vertical axis) toward the bottom wall 22. A bottom section 70 transitions the ramp section 68 to the bottom wall 22. Also, the front side wall portion 34 extends generally downward. It is noted that in alternative embodiments, the front side wall portion 34 may also extend inward at a slight angle, although not at as great and angle as the ramp sections 62, 64 and 68. Alternatively, the ramp section 62, 64 and 68 may extend the entire length of the respective side wall portion, or may not extend completely to the bottom wall 22, e.g., another vertical wall section transitions the respective ramp section to the bottom wall 22.

The ramp section 68 generally cooperates with the normal front side wall portion 34 to push the meat slices forwardly toward alignment with the center 99 of the bottom wall 22. Additionally, as illustrated in FIG. 15, this positioning of the compartment as well as the tapered configuration of the ramp section 68 of the rear side wall portion 28 shifts the weight of the meat forwardly in the compartment 14 so that the center-of-gravity of the package is lower when the package 10 is rotated to stand-up on edge in the display orientation of FIG. 1B. Thus, a more stable package 10 is provided that is less susceptible to toppling over.

The ramp section 68 of the rear side wall portion 28 acts to push or bias the meat slices upwardly in the compartment 14 as the volume of the compartment 14 progressively enlarges toward the upper end thereof, as has been mentioned. Again, when pivoted for display, this lifting action on the meat slices will cause the weight of the meat to be shifted forwardly in the vertically oriented package (see FIG. 15).

The ramp section 68 further functions to hold the food product contained within the compartment 14 upward toward the lid 18 and inward toward alignment with the center 99 of the bottom wall 22 (i.e., in a direction toward the front side wall portion 34) in order to better display the food product through the windows 30 of the lid 18. Additionally, the ramp section 68 also functions to better contain the food product within the compartment in order to minimize movement of the product during distribution and storage; thus, advantageously, better preserving the fluffed look of sliced food products. For example, the ramp section 68 reduces front-to-back movement of the food product within the compartment 14. The vertically dropping upper section 60 functions to provide structural stability to the base member 12 which is helpful to minimize package abuse during distribution, as well as provide a volume within which the lid 18 will nest into.

In preferred embodiments, the decline angle of ramp section 68 is greater than the decline angle of ramp sections 62 and 64 relative to the vertical axis, e.g., $\theta_2>\theta_1$. In preferred embodiments, $\theta_1$ is an angle between about 55-75 degrees, most preferably about 62.5 degrees, while $\theta_2$ is an angle between about 65-75 degrees, most preferably about 69 degrees. The exact angles selected and dimensions of the various side walls will vary depending on the implementation and the food product to be contained therein. The exact angles selected and dimensions of the various side walls will vary depending on the implementation and the food product to be contained therein.

The taper of the ramp section 68 and the lack of such a taper on the front side wall portion 34 are such that the center of the bottom wall 99 is shifted forwardly in the package, as previously discussed. The rear side wall portion 28 can be tapered such that not only is the bottom wall 22 off-center, but so that its rear edge 96 is also disposed forwardly of the base center 98 (see FIG. 4A). In one form, the rear side wall portion 28 can be more gradually tapered than the tapered opposite side wall portions 24, 26, and it can be provided with a longer length in its tapering direction so as to position and shift the bottom wall 22 forwardly in the package.

Together, the side wall portions 24, 26, 28 and the front side wall portion 34 form a tapered compartment within which the food product is contained such that the side-to-side and front-to-back movement of the food product within the compartment is minimized. Additionally, the side wall portions 24, 26, 28 and the front side wall portion 34 provide a clean, angled aesthetic look to the food package 10. Overall, the ramp sections 62, 64, 68 of the side wall portions 24, 26, 28 reduce the volume of the compartment 14 that will contain the food product in comparison to a compartment forming a rectangular volume therein such that the same amount of food product will be better displayed when viewed through the window(s) 30 of the lid 18.

The package, and specifically the base member 12 thereof is also adapted to shift the center-of-gravity of its contents as described above for being oriented vertically for display purposes, while maintaining the stability of the packages in their horizontal orientation. More particularly, the base member 12 has wells or foot portions 36 formed at either rear corner that serve as feet for the base when horizontally disposed, e.g., stored in a distribution truck, retailer storage shelf or a consumer refrigerator. The space in each foot portion 36 is significantly less than that in the main compartment 14 in which the meat slices are received. As such, the size of the foot portions 36 should be reduced relative to the size of the compartment 14. Thus, any meat that may be located in the foot portions 36 is also kept to a minimum.

When the package is pivoted to its display orientation, the foot portions 36 will be toward the top of the package. Because the weight of the material used for the walls of the foot portions 36 is small relative to the weight of the food product, the foot portions 36 do not cause the package to be top heavy in the vertical position which otherwise can cause undesired instability and tipping problems. At the same time, the foot portions 36 are formed to approximately the same depth as the main compartment 14 so that their bottom walls 38 are aligned (preferably coplanar with) with that of the main compartment 14 to provide stable support for the base member 12 in its horizontal orientation.

The taper of the side wall portions 24, 26 of the main compartment 14 spaces the opposite side or end edges of the rectangular compartment bottom wall 22 inwardly from the corresponding side or ends of the base member 12 at the upper periphery thereof. Further, the tapered ramp section 68 of the rear side wall portion 28 spaces the compartment bottom wall 22 forwardly in the base member 12. Accordingly, as best viewed in FIG. 4B, the bottom wall 22 of the food compartment 14 is disposed intermediate the bottom walls 38 of the rear corner foot portions 36 and forwardly therefrom so that the three bottom walls 22, 38 are arranged in a triangular orientation relative to each other. This triangular spacing or arrangement of the bottom walls 22, 38 provides a secure tripod support for the base 12 in its horizontal position. Additionally, as illustrated in FIG. 16, the rear foot portions 36 are shaped to nest within the lid 18 of adjacent packages in a horizontal stack for reducing side-to-side movement of packages within a stack, while the front wall portion 34 nests into the lid 18 of adjacent packages in the horizontal stack together with the rear wells or foot portions 36 for reducing front-to-back movement of the packages within the stack.

Preferably, each foot portion 36 is formed as a small well in the rear corners of the base member 12 and formed generally at the junction of the rear side wall portion 28 and a respective adjacent side wall portion 24, 26. The foot portions 36 are designed having dimensions such that the food product does not generally sit within the well formed by the foot portion 36. If a substantial portion of the food product were to rest within the foot portion 36, the center of gravity of the food package 10 when standing up on-end (e.g., standing in the display orientation of FIG. 1B on edge 35 and the front side wall portion 34), the center of gravity of the food package 10 would be slightly higher than if the food product did not fit within the foot portions 36. Thus, by sizing the foot portions 36 relative to the food product such that a substantial portion of the food product does not fit within the volume formed by the foot portion 36, the stability of the package 10 in the display orientation is improved. As stated above, the purpose of the foot portions 36 is to aid in the stability of the food package 10 in the horizontal orientation of FIG. 1A without affecting the functionality of the tapered side wall portions 24, 26, 28. Additionally, the sizing of the foot portions 36 is designed to be small enough to limit the amount of food product that may fit within the foot portion, yet large enough to be easily and cost effectively produced, for example, using known thermoforming techniques. For example, the smaller the foot portion, the more material required to form a foot portion having a specified thickness. Thus, in preferred embodiments, processing considerations also affect the overall size of the foot portions 36.

As illustrated best in FIG. 4A, the foot portions 36 generally have several wall sections 74, 76, 78, 80, 82, 84, 86, 88, 90 and 92 that extend downwardly towards an irregularly shaped pentagonal base 38. Wall sections 74, 76 and 78 generally follow the dimensions of the opening 20 of the compartment. In other words, wall sections 74, 76 and 78 generally follow the outer edges of the rear side wall portion 28 and the respective side wall portion 24, 26, i.e., wall sections 74 are parallel to the upper section 60 of respective ones of side wall portions 24 and 26, while wall sections 78 are parallel to the upper section 60 of the rear side wall portion 28. Each of the wall sections 74, 76, 78, 80, 82, 84, 86, 88, 90 and 92 extend generally vertically downward toward the base 38 and then extend vertically and taper slightly in one or more sections at an oblique angle to the base 38.

It should be noted that many variations may be made to foot portions 36 consistent with the present invention. For example, the exact geometric shape of the foot portions 36 may be varied to suit the particular package and food product. Thus, the foot portions 36 may have a different number of wall sections that may be curved or straight and may have a differently shaped base 38. It should be noted that although in preferred embodiments, a respective foot portion 36 is formed in each of the rear corners of the base member 12, in other embodiments, a single foot portion positioned centrally along the rear side wall portion may be employed or another arrangement of multiple foot portions 36. Generally, whatever the specific configuration of the foot portion 36, the foot portion(s) 36 should be configured to provide support for one or more food packages in a horizontal orientation while not substantially reducing the functionality of the ramp section 68 of the rear side wall portion 28.

In other embodiments, the base 38 of the foot portion 36 may be continuous with the bottom wall 22, such that the bottom wall 22 extends towards the respective corners and is contiguous with the base 38; however, foot portions 36 separate from the bottom wall 22 are preferable since such alternative arrangement will shift the center of gravity of the food package 10 slightly upward when the food package is in the stand-up display orientation of FIG. 1B.

Turning to more of the details, another feature illustrated in FIGS. 1A-6 is that vertical channels 94 are formed in the upper sections 60 of the side wall portions 24, 26, 28, the front side wall portion 34, as well as within sections of the foot portions 36 (e.g., foot walls 74 and 78). These vertical extending channels 94 extend generally outward from the compartment 14 and run vertically along the respective wall sections. They functional provide additional structural stability to the food package such that the food package will be better able to withstand top-to-bottom compression forces. This again serves to minimize package abuse during distribution. Minimizing package abuse is important to preserving the fluffed look of the sliced food product, since disturbance of the package dimensions through externally applied forces to the package surface will disturb the fluffed food product contained within and ultimately reduce the fluffed appearance of the product.

Additionally, since the food package 10 is preferably a gas-flushed package, the channels 94 function to assist evacuating air trapped along the sides and underneath the food product 16. That is, the channels 94 provide a space for air to flow, during the vacuum packing process, excess air underneath and to the side of the food product can more easily be evacuated from the package 10. Additionally, the channels 94 also provide a certain aesthetic look to the overall package design.

Figure 13:
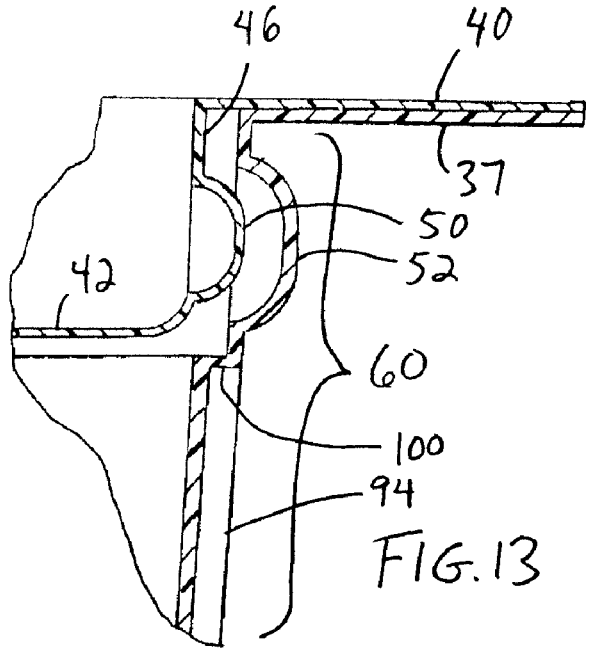
FIG. 13 is a cross sectional view of the re-closing mechanism formed in the lid walls of the lid and the upper sections of the various side wall portions of the base member according to one embodiment.

Furthermore, as illustrated in FIGS. 7, 8 and 13, the upper sections include horizontal ledges 100. The channels 94 begin at the horizontal ledges 100 such that the outer edge of the horizontal ledge defines the outer periphery of the channels 94 extending downward while the inner edge of the horizontal ledge defines the inner periphery of the channels 94 extending downward.

Referring next to FIGS. 9-12, further details of the lid of FIG. 2 will be described. As illustrated in FIGS. 9-12, the lid 18 appears without the label 32 affixed thereto. The lid 18 includes a lip or ridge portion 40 generally matching the geometry of the ridge portion 37 of the base member 12 and defining a periphery of the food package 10. The lid 18 further includes lid walls 46 that extend vertically downward a distance and terminate at a flat lid cover wall 42 so that walls 42, 46, 48 cooperate to form a plug portion of the lid 18. These lid walls 46 transition to each other at curved corner walls 48. The lid walls 46 are adapted to fit within a vertical drop section of the base member 12 formed by the upper sections 60 of the side wall portions 24, 26, 28 and the upper section of the front side wall portion 34. Thus, the ridge portion 40 of the lid 18 extends transverse to the vertical lid walls 46, 48 from the upper ends thereof for resting on the ridge portion 37 of the base member 12 with the lid cover wall 42 extending into the opening by approximately the distance of the lid walls 46. As further illustrated the ridge portion 40 is preferably in a separate parallel plane than the lid cover wall 42. The contacting ridge portions 37 and 40 prevent the lid cover wall 42 from extending any further into the volume of the compartment 14. As such, the outward facing surfaces of the lid walls 46 fit within the dimensions of the inward facing surfaces of the upper sections 60 of the side wall portions 24, 26, 28 and the upper section of the front side wall portion 34. Thus, the lid 18 is adapted to nest into position within the opening of the compartment 14.

Also provided are lugs 50 formed within the lid walls 46 that extend outward from the lid walls 46. These lugs 50 are adapted to fit within corresponding recesses 52 formed within the upper sections 60 of the side wall portions 24, 26, 28 and the upper section of the front side wall portion 34. The recesses 52 are channels that generally correspond to the geometry of the lugs 50 such that when the lid 18 is inserted into the opening 20 of the compartment, respective lugs 50 snap into the respective recesses 52 to re-close the package. In preferred embodiments, this re-closing mechanism provides an audible snap indicating that the package is closed. This alerts the consumer that the package is re-closed after the package has been unsealed; however, this closure mechanism does not hermetically re-seal the food product within the compartment. The lugs 50 and recesses 52 also provide some resistance to the unintended opening of the food package after it has been unsealed. For example, in preferred embodiments, the snap fit of the lugs 50 and recesses 52 are designed such that the food package 10 may be turned upside down and the lid 18 will not pop off due to the weight of the food product on the lid 18. As such, the consumer needs to apply a small amount of force to re-open the closed food package.

Referring briefly to FIG. 13, a cross sectional view of the re-closing mechanism according to one embodiment is illustrated. As illustrated, the lug 50 is adapted to snap into the recess 52 when the ridge portions 37 and 40 are flush. Since the outer dimension of the lug 50 extends slightly beyond the inner dimension of the upper section 60 of the side wall portion, both the upper section 60 and the lug 50/lid wall 46 give slightly with downward pressure on the lid 18 to snap the lug 50 into the recess 52. Notice that the horizontal ledge 100 of the upper section 60 and channel 94 are visible in FIG. 13 illustrating that the upper section 60 extends downward then inward the length of the horizontal ledge 100, then continues to extend downward until it further transitions to the appropriate ramp section (or alternatively extends vertically to the bottom wall for the front side wall portion 34).

Referring back to FIGS. 9-12, the lid 18 also includes a first sealing surface 54 on the bottom side of the ridge portion 40. Note that the first sealing surface 54 is illustrated through the generally transparent ridge portion 40 of the lid 18 in FIG. 10. This first sealing surface 54 extends about the periphery of the ridge portion 40 and is adapted to mate with a corresponding second sealing surface 56 formed on the top surface of the ridge portion 37 of the base member 12. The second sealing surface 56 of the base member 12 also extends about a periphery of the ridge portion 37 of the base member 12. In order to seal the lid 18 to base member 12, a heat sealant is applied to the first and second sealing surfaces 54 and 56, and once the lid is positioned within the opening 20 of the compartment 14, the sealant is heat activated; thus, forming a hermetic seal between the lid 18 and the base member 12 at the first and second sealing surfaces 54 and 56.

In order to unseal the package 10, tab portions 58 formed at a corner of the ridge portion 40 of the lid 18 and at a corner of the ridge portion 37 of the base member 12 are pulled apart. Corresponding bumps 59 are provided in the tab portion 58 of both the lid 18 and the base member 12. These bumps 59 are configured to maintain a separation distance between the tab portions 58 of the lid 18 and the base member 12 so that it is easier for the consumer to pull the tab portions 58 apart. It is noted that the alignment of the bumps 59 (also referred to as protrusions or indentations) of the lid 18 and the base member 12 is illustrated in FIG. 2. The tab portions 58 are positioned to overlap each other once the lid is sealed into the base member, with the bumps 59 aligned over the top of each other. At the tab corner, the first and second sealing surfaces 54 and 56 preferably extend to the edge of the corner; however, the heat sealant is not activated at the outer edge of the tab corner near the bumps 59, i.e., forming the tab portions 58. To unseal the package 10, the consumer simply pulls the tab portions 58 apart with sufficient force to separate the lid 18 and the base member 12. It is noted that the amount of force to unseal the package should be greater than the force to unseat the lugs 50 from within the recesses 50. Once unsealed, as described above, the lid 18 may be reclosed back into the opening of the base member 12, the lugs 50 and corresponding recesses 52 indicating that the package has been closed (although not hermetically resealed).

In another feature, the lid cover wall 42 includes flat support channels 44 that extending downward a slight distance, e.g., less than the thickness of the lid 18. These support channels 44 serve to strengthen the lid 18 and prevent deformation of the lid during the unsealing. Since the lid 18 is designed to be reclosable by the consumer once unsealed, the lid should be able to retain its shape once subjected to the normal opening force when the consumer unseals the package. The support channels 44 help to reduce the likelihood that the lid 18 and lugs 50 will be deformed during opening such that it may be adequately reclosed by the consumer in use. In preferred embodiments, the support channels are arranged such that the length of the support channel 44 extends along the lid cover wall 42 in a direction to resist the curvature of the lid during opening, e.g., the support channels 44 extend along the longer dimension of the rectangular shape of the lid 18.

Figure 10:
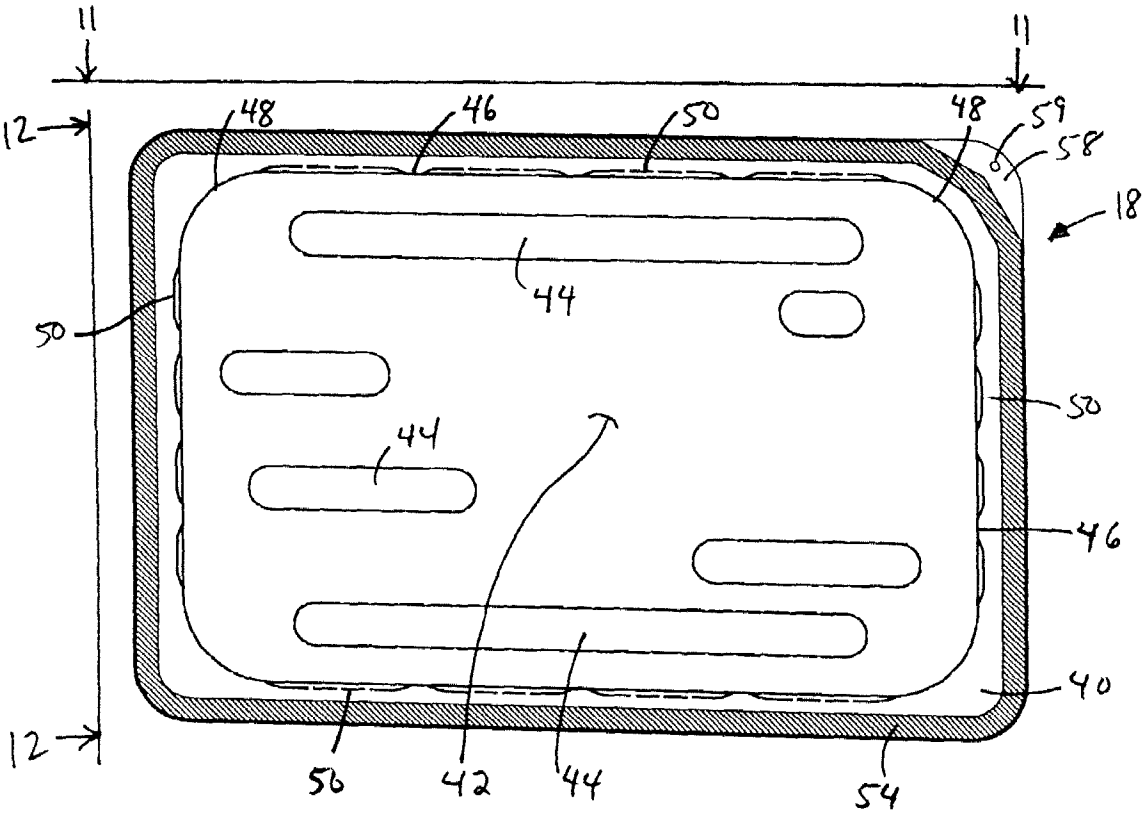
FIG. 10 is a top plan view of the lid of FIG. 9.
Figure 12:
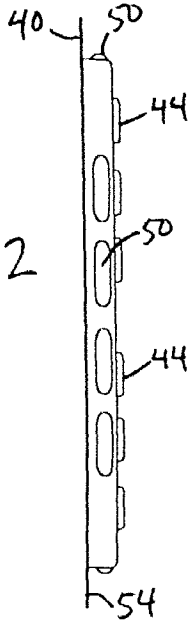
FIG. 12 is an end elevational view taken along line 12-12 of FIG. 10.
Figure 14A:
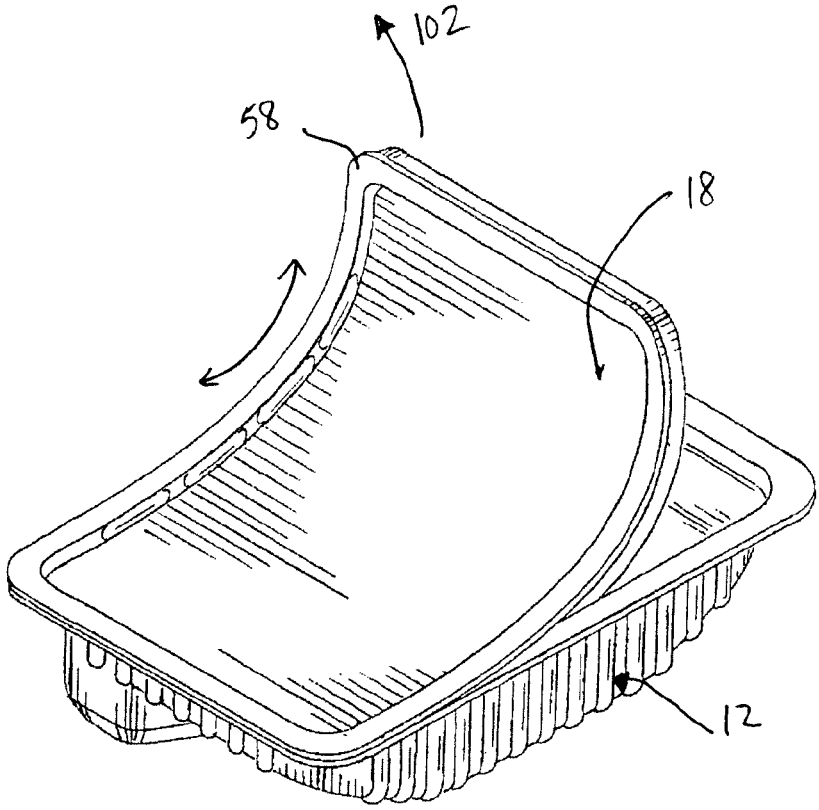
FIGS. 14A and 14B are schematic views of a food package described herein illustrating the deforming effect of the unsealing process on the lid with (FIG. 14B) and without (FIG. 14A) support channels formed in the lid.
Figure 14B:
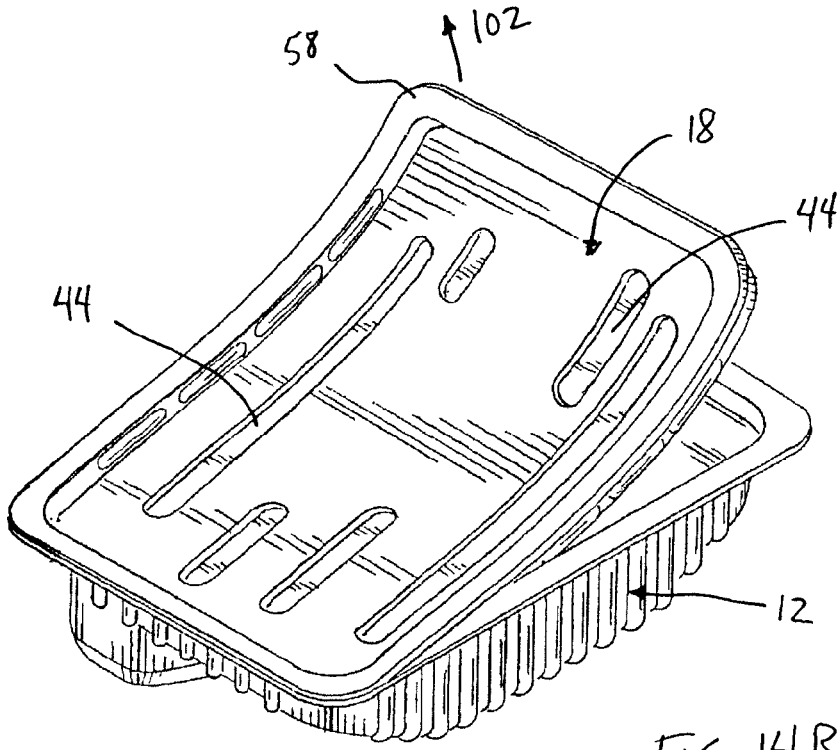

For example, in the illustration of FIG. 10 and the simplified illustrations of FIGS. 14A and 14B, a user will likely open the package by pulling the tab portions 58 apart and lifting the lid 18 relative to the base member 12, e.g., in the direction of arrow 102. As the lid unseals in a direction moving from the right side of the lid to the left side of the lid 18, without any such channels 44, the lid 18 itself may tend to bow in a curved manner (such as illustrated in FIG. 14A) and remain bowed after the unsealing is complete, thus, making it difficult to re-close properly. However, support channels 44 should help to provide structural stability in the lid to reduce this deforming effect, such as illustrated in FIG. 14B. Thus, in preferred embodiments, the channels 44 add to the structural stability of the lid and assist in maintaining the shape of the lid after unsealing. This increases the likelihood that the re-closing mechanism (e.g., lugs 50 and recesses 52) will work properly and for many openings and re-closings.

The support channels 44 are also arranged with the product label 32 in mind. For example, preferably the support channels 44 are positioned under the opaque portions of the label 32 and are not viewable through the window(s) 30 of the label 32 in position over the lid cover wall 42, such as illustrated in FIGS. 1A and 1B.

Referring next to FIG. 15, a simple side elevational view is shown illustrating the center of gravity 104 of the food package in the display orientation of FIG. 1B including a food product 16 having a rear side wall portion 28 as described herein in comparison to the center of gravity 106 if the ramp section 68 of the rear side wall portion 28 did not extend at an oblique angle towards the bottom wall 22. For example, if the rear side wall portion were similar to the front side wall portion 34, more of the product 16 would sit closer to the top of the package and slightly closer to the right (in FIG. 15); thus, the center of gravity 106 is higher and toward the bottom wall 22 of the package and the package is less stable, i.e., more susceptible to falling over.

The taper of the ramp section 68 of the rear side wall portion 28 generally cooperates with the normal front side wall portion 34 to push the meat slices forwardly toward alignment with the center of the bottom wall 22. As mentioned, this positioning of the compartment 14 as well as the tapered configuration of the compartment rear side wall shifts the weight of the meat forwardly in the compartment so that the center-of-gravity of the package is lower when the package is pivoted to stand on the ridge portion and the support surface 108 of its front side wall portion 34 for display.

Another effect that the tapered configuration of the side wall portions 24, 26, 28 provides is to push or bias the meat slices upwardly (in the horizontal orientation) in the compartment as the volume of the compartment progressively enlarges toward the upper end thereof, as has been mentioned. Again, when pivoted for display, this lifting action on the meat slices will cause the weight of the meat to be shifted forwardly (to the left in FIG. 15) in the vertically oriented package. Since in its generally vertical orientation, the package preferably is slightly tilted rearward to rest on the support surface 108, e.g., the corner junction of the front side wall portion 34 and the bottom wall 22, this forward weighting of the package further assists in stabilizing it for display. Thus, the forward position of the compartment and the taper of the compartment side wall portions cause the center-of-gravity 104 (in comparison to the center-of-gravity 106) of the vertically oriented package to be lowered and shifted toward the front of the package, so that the package is more resistant to tipping and falling over when pivoted to its display position. As such, the package 10 may be displayed in the display orientation on a retailer's shelf without the need for special merchandisers to hold the packages 10 in an upright position. It is further understood that other embodiments of the package may be configured to be held within merchandisers.

Referring next to FIG. 16, it is illustrated that the rear foot portions 36 and the front side wall portion 34 of each food package 10 are adapted to nest within the volume formed about the ridge portion 40 of the lid 18 of a food package 10 immediately underneath the food package in a stack 110 of packages 10. Thus, the base of the foot portion 36 rests on the corner portion of the lid cover wall 42 while the foot wall sections 74, 76 and 78 nest against the lid walls 46 and 48. Furthermore, the front side wall portion 34 nests against the front lid wall 46. As such, the tripod support of the bottom of the compartment (i.e., the two rear corner foot portions 36 and the bottom wall 22) nest within an adjacent lid 18 of the stack 110. This advantageously limits lateral movement, e.g., front-to-back movement and side-to-side movement, of the individual food packages 10 within the stack 110 and also provides for adequate support for the food packages of the stack 110 so that the stack does not tip over.

In manufacturing a food package as described herein, the lid 18 and the base member 12 are preferably thermoformed plastic. As is well known, one of ordinary skill in the art could use known thermoforming techniques to manufacture the lid and base member including all of the features as described herein. Additionally, in preferred embodiments, the lid and the base member are manufactured at the same time, then filled with the food product. The food package is then gas flushed and heat sealed as is known. One or more labels may then be affixed to the food package, such as illustrated in FIGS. 1A and 1B.

In preferred embodiments, the volume of the compartment 14 of the preferred package 10 is configured for approximately 9 ounces of client food product. Additionally, in the preferred form, the dimensions of the preferred base member 12 are as follows: the outer periphery is 199.5 mm by 134.5 mm; the opening 20 of the compartment 14 is 180.5 by 116.5 mm; the thickness of the channels 94 is 1 mm; the distance between the center of adjacent channels 94 is 11 mm; the distance covered by the channels 94 in each of the front side wall portion 34 and the rear side wall portion 28 is 132 mm; the width of the sealing surface 56 is 5 mm extending around the periphery of the ridge portion 37; the bottom wall 22 is 76.06 by 39.6 mm; the decline angle of ramp section 68 $\theta_2$ is 69.0 degrees; the decline angle of ramp sections 62, 64 $\theta_1$ 62.5 degrees; the decline angle of the lower portion of foot walls 74, 76, 78, 80, 82, 84, 86, 88, 90, 92 is 30 degrees as they transition to the base 38; the height of the base member 12 is 44.45 mm; and the height from the bottom wall 22 to the top of the ledge 100 is 37.65 mm.

Additionally, in the preferred form, the dimensions of the preferred lid 18 are as follows: the outer periphery is 199.5 mm by 134.5 mm; the inner periphery defined by lid walls 46 (i.e., the outer periphery of the lid cover wall 42) is 177.7 by 115.5 mm; the height of the lid 18 (the distance from the top of the ridge portion 40 to the bottom of the lid cover wall 42) is 6.5 mm; the distance from the top of the ridge portion 40 to the center of a respective lug is 3.75 mm; the lugs 50 along the width of the lid 18 are 6 mm long; the lugs 50 along the length of the lid 18 are 24 mm long; the width of the sealing surface 54 is 5 mm extending around the periphery of the ridge portion 40; and the channels 44 are 10 mm wide and 1.5 mm thick; the lugs 50 are 1.3 mm deep.

It is noted that the above represents the dimensions of the package in its preferred form, although the exact angles selected and dimensions of the package 10 will vary depending on the implementation and the food product to be contained therein.

While the invention herein disclosed has been described by means of specific embodiments and applications thereof, numerous modifications and variations could be made thereto by those skilled in the art without departing from the scope of the invention set forth in the claims.

What is claimed is:

1. A package for containing a sliced food product, the package comprising:

a compartment effective for receiving and containing slices of the food product;

a bottom wall of the compartment;

an opening to the compartment above the bottom wall, the opening having a substantially rectangular shape;

side wall portions of the compartment upstanding from the bottom wall;

a film cover which covers and seals the opening;

wherein the side wall portions comprise:

a first side wall portion having a first ramp section that extends downward and inward toward the bottom wall at a first oblique angle, the first oblique angle between about 55-75 degrees relative to a vertical axis when the package is arranged in a horizontal orientation; and a second side wall portion opposing the first side wall portion, the second side wall portion having a second ramp section that extends downward and inward toward the bottom wall at a second oblique angle, the second oblique angle between about 55-75 degrees relative to the vertical axis when the package is arranged in the horizontal orientation, wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover;

the first side wall portion having a first portion extending substantially vertically downward from the first ramp section, the first portion having a first base; and the second wall portion having a second portion extending substantially vertically downward from the second ramp section, the second portion having a second base, the second base is parallel to the first base.

2. The package of claim 1 wherein the second base is parallel to and coplanar with the first base.

3. The package of claim 1 wherein the first base and the second base are parallel to the bottom wall.

4. The package of claim 1 wherein the first base and the second base are parallel to and coplanar with the bottom wall.

5. The package of claim 1 wherein the first oblique angle and the second oblique angle are substantially the same.

6. The package of claim wherein the first ramp section and the second ramp section each extend downward and inward toward the bottom wall substantially uniformly at the first oblique angle and the second oblique angle.

7. The package of claim 1 wherein the first ramp section opposes the second ramp section.

8. The package of claim 1 wherein the first portion and the second portion are adapted to provide support for the package in the horizontal orientation.

9. The package of claim 1 wherein the first side wall portion has a first upper section that extends substantially vertically downward from the opening to the first ramp section; and wherein the second side wall portion has a second upper section that extends substantially vertically downward from the opening to the second ramp section.

10. The package of claim 1 further comprising channels formed in at least a portion of one or more of the side wall portions, the channels extending outward from the compartment and extending lengthwise substantially vertically, the channels adapted to provide structural stability to the food package and to assist in gas flushing the package.

11. The package of claim 1 in combination with the slices of the food product contained within the compartment.

12. The package of claim 1 further comprising:

a heat seal formed between the film cover and the compartment which hermetically seals the compartment.

13. The package of claim 1 wherein an upper edge of both the first ramp section and the second ramp section is substantially horizontal.

14. The package of claim 1 wherein the side wall portions each correspond to a respective side of the substantially rectangular shape of the opening, wherein the sides of the substantially rectangular shape define an x axis and a y axis;

wherein the first ramp section extends downward and inward toward the bottom wall at the first oblique angle about one of the x axis and the y axis; and wherein the second ramp section extends downward and inward at the second oblique angle toward the bottom wall about the one of the x axis and the y axis.

15. The package of claim 1 wherein the first portion and the second portion each define a volume generally not for containing the slices of the food product.

16. A package for containing a sliced food product, the package comprising:

slices of a food product;

a compartment effective for receiving and containing the slices of the food product;

a bottom wall of the compartment;

an opening to the compartment above the bottom wall, the opening having a substantially rectangular shape;

side wall portions of the compartment upstanding from the bottom wall;

a film cover which covers and hermetically seals the opening;

wherein the side wall portions comprise:

a first side wall portion having a first ramp section that extends downward and inward toward the bottom wall substantially uniformly at a first oblique angle, the first oblique angle between about 55-75 degrees relative to a vertical axis when the package is arranged in a horizontal orientation; and a second side wall portion opposing the first side wall portion, the second side wall portion having a second ramp section that extends downward and inward toward the bottom wall substantially uniformly at a second oblique angle, the second oblique angle between about 55-75 degrees relative to the vertical axis when the package is arranged in the horizontal orientation, wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover;

the first side wall portion having a first portion extending substantially vertically downward from the first ramp section, the first portion having a first base; and the second wall portion having a second portion extending substantially vertically downward from the second ramp section, the second portion having a second base, the second base is parallel to and coplanar with the first base;

wherein the first base and the second base are parallel to the bottom wall;

wherein the first ramp section opposes the second ramp section;

wherein the first side wall portion has a first upper section that extends substantially vertically downward from the first opening to the first ramp section;

wherein the second side wall portion has a second upper section that extends substantially vertically downward from the opening to the second ramp section;

wherein an upper edge of both the first ramp section and the second ramp section is substantially horizontal; and wherein the side wall portions each correspond to a respective side of the substantially rectangular shape of the opening, wherein the sides of the substantially rectangular shape define an x axis and a y axis;

wherein the first ramp section extends downward and inward toward the bottom wall at the first oblique angle about one of the x axis and the y axis; and wherein the second ramp section extends downward and inward at the second oblique angle toward the bottom wall about the one of the x axis and the y axis.

17. The package of claim 16 wherein the first portion and the second portion each define a volume generally not for containing the slices of the food product.

18. A package for containing a sliced food product, the package comprising:

slices of a food product;

a compartment effective for receiving and containing the slices of the food product;

a bottom wall of the compartment which forms a horizontal base when the package is in a horizontal position and is resting on the bottom wall;

a rectangular opening to the compartment above and opposite the bottom wall, the rectangular opening being larger than the bottom wall;

side wall portions of the compartment upstanding from the bottom wall;

a film cover which covers and seals the rectangular opening;

wherein the side wall portions comprise:

a first side wall portion having a first ramp section that extends downward and inward toward the bottom wall substantially uniformly at a first oblique angle between about 55-75 degrees relative to a vertical axis when the package is arranged in a horizontal orientation; wherein an upper edge of the first ramp section is substantially horizontal when the package is arranged in the horizontal orientation;

a second side wall portion opposing the first side wall portion, the second side wall portion having a second ramp section that extends downward and inward toward the bottom wall substantially uniformly at a second oblique angle between about 55-75 degrees relative to the vertical axis when the package is arranged in the horizontal orientation, wherein the first ramp section opposes the second ramp section, wherein an upper edge of the second ramp section is substantially horizontal when the package is arranged in the horizontal orientation; wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover;

a third side wall portion extending downward toward the bottom wall; and a fourth side wall portion extending downward toward the bottom wall and opposing the third side wall portion;

the first side wall portion having a first portion extending substantially vertically downward from the first ramp section, the first portion having a first base; and the second wall portion having a second portion extending substantially vertically downward from the second ramp section, the second portion having a second base, the second base is parallel to can coplanar with the first base, wherein the first base and the second base are parallel to the bottom wall, wherein the first portion and the second portion each define a volume generally not for containing the slices of the food product;

wherein the first side wall portion has a first upper section that extends substantially vertically downward from the rectangular opening to the first ramp section;

wherein the second side wall portion has a second upper section that extends substantially vertically downward from the rectangular opening to the second ramp section; and wherein the side wall portions each correspond to a respective side of the rectangular opening, wherein the sides of the substantially rectangular shape define an x axis and a y axis;

wherein the first ramp section extends downward and inward toward the bottom wall at the first oblique angle in a first direction about one of the x axis and the y axis; and wherein the second ramp section extends downward and inward toward the bottom wall at the second oblique angle in a second direction about the one of the x axis and the y axis, the second direction being opposite the first direction.

19. The package of claim 18 wherein the third side wall portion and the fourth side wall portion each have channels formed therein extending vertically and outwardly from the package.

20. A package for containing a sliced food product, the package comprising:

slices of a food product;

a compartment effective for receiving and containing the slices of the food product;

a bottom wall of the compartment which forms a horizontal base when the package is in a horizontal position and is resting on the bottom wall;

a rectangular opening to the compartment above and opposite the bottom wall, the rectangular opening being larger in area than the bottom wall;

side wall portions of the compartment upstanding from the bottom wall;

a rim surrounding the rectangular opening and extending in a plane generally parallel to the bottom wall; and a lid which snappingly engages an upper periphery of the compartment to cover the rectangular opening;

wherein the side wall portions comprise:

a first side wall portion having a first ramp section that extends downward and inward toward the bottom wall substantially uniformly at a first oblique angle between 55-75 degrees relative to a vertical axis when the package is arranged in a horizontal orientation; wherein an upper edge of the first ramp section is substantially horizontal when the package is arranged in the horizontal orientation;

a second side wall portion opposing the first side wall portion, the second side wall portion having a second ramp section that extends downward and inward toward the bottom wall substantially uniformly at a second oblique angle between about 55-75 degrees relative to the vertical axis when the package is arranged in the horizontal orientation, wherein the first ramp section opposes the second ramp section, wherein an upper edge of the second ramp section is substantially horizontal when the package is arranged in the horizontal orientation; wherein at least the first ramp section and the second ramp section cause the compartment to be tapered and adapted to engage the food product to minimize movement of the food product to be contained therein and wherein the first ramp section and the second ramp section are adapted to lift the food product upward toward the film cover such that the food product can be viewed through at least a portion of the film cover;

a third side wall portion extending downward toward the bottom wall; and a fourth side wall portion extending downward toward the bottom wall and opposing the third side wall portion;

the first side wall portion having a first portion extending substantially vertically downward from the first ramp section, the first portion having a first base; and the second wall portion having a second portion extending substantially vertically downward from the second ramp section, the second portion having a second base, the second base is parallel to and coplanar with the first base, wherein the first base and the second base are parallel to the bottom wall, wherein the first portion and the second portion each define a volume generally not for containing the slices of the food product;

wherein the first side wall portion has a first upper section that extends substantially vertically downward from the rectangular opening to the first ramp section;

wherein the second side wall portion has a second upper section that extends substantially vertically downward from the rectangular opening to the second ramp section; and wherein the first side wall portion has a first upper section that extends substantially vertically downward from the rectangular opening to the first ramp section;

wherein the second side wall portion has a second upper section that extends substantially vertically downward from the rectangular opening to the second ramp section; and wherein the side wall portions each correspond to a respective side of the rectangular opening, wherein the sides of the substantially rectangular shape define an x axis and a y axis;

wherein the first ramp section extends downward and inward toward the bottom wall at the first oblique angle in a first direction about one of the x axis and the y axis; and wherein the second ramp section extends downward and inward toward the bottom wall at the second oblique angel in a second direction about the one of the x axis and the y axis, the second direction being opposite the first direction.

21. The package of claim 20 wherein the lid and the compartment include a reclosing mechanism for allowing the lid to be reclosed over the rectangular opening after the lid is removed from the compartment.

22. The package of claim 20 further comprising at least one channel formed in the lid.

23. The package of claim 22 wherein the lid is substantially rectangular and the at least one channel extends along a direction parallel to a major edge of the lid.

* * * * *

UNITED STATES PATENT AND TRADEMARK OFFICE

CERTIFICATE OF CORRECTION

PATENT NO. : 7,731,997 B2
APPLICATION NO. : 12/030839
DATED : June 8, 2010
INVENTOR(S) : Castellanos et al.

It is certified that error appears in the above-identified patent and that said Letters Patent is hereby corrected as shown below:

On the Title Pg, Item (73) (Assignee:), after "Brands" delete ",".

- In Col. 24, Line 56, in Claim 6, delete "claim" and insert -- claim 1 --.

- In Col. 26, Line 11, in Claim 16, delete "first opening" and insert -- opening --.

- In Col. 26, Line 40, in Claim 18, delete "larger" and insert -- larger in area --.

- In Col. 27, Line 15, in Claim 18, delete "can" and insert -- and --.

- In Col. 27, Line 65, in Claim 20, delete "between" and insert -- between about --.

- In Col. 28, Lines 47-53, in Claim 20, below "and" delete "wherein the first side wall portion has a first upper section that extends substantially vertically downward from the rectangular opening to the first ramp section; wherein the second side wall portion has a second upper section that extends substantially vertically downward from the rectangular opening to the second ramp section; and".

- In Col. 28, Line 65, in Claim 20, delete "angel" and insert -- angle --.

Signed and Sealed this
Nineteenth Day of April, 2011

David J. Kappos

David J. Kappos
*Director of the United States Patent and Trademark Office*